US011686183B2

(12) United States Patent
Brady

(10) Patent No.: US 11,686,183 B2
(45) Date of Patent: Jun. 27, 2023

(54) FIRING HEAD AND METHOD OF UTILIZING A FIRING HEAD

(71) Applicant: DynaEnergetics Europe GmbH, Troisdorf (DE)

(72) Inventor: Thomas Ryan Brady, Katy, TX (US)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/502,147

(22) Filed: Oct. 15, 2021

(65) Prior Publication Data

US 2022/0034207 A1 Feb. 3, 2022

Related U.S. Application Data

(63) Continuation of application No. 16/695,729, filed on Nov. 26, 2019, now Pat. No. 11,174,713.
(Continued)

(51) Int. Cl.
*E21B 43/1185* (2006.01)

(52) U.S. Cl.
CPC .. *E21B 43/11852* (2013.01); *E21B 43/11855* (2013.01)

(58) Field of Classification Search
CPC .. E21B 23/04; E21B 23/0413; E21B 23/0414; E21B 23/042; E21B 23/06;
(Continued)

(56) References Cited

U.S. PATENT DOCUMENTS 2,807,325 A 9/1957 Webb
4,499,951 A 2/1985 Vann
(Continued)

FOREIGN PATENT DOCUMENTS

CA 3020004 C 9/2019
CN 101070755 B 6/2010
(Continued)

OTHER PUBLICATIONS

Hunting, Direct Pressure Firing Head, 2013, 2 pgs., http://www.hunting-intl.com/media/1962149/DirectPressureFiringHeads.pdf.
(Continued)

*Primary Examiner* — Jennifer H Gay
(74) *Attorney, Agent, or Firm* — Womble Bond Dickinson (US) LLP

(57) ABSTRACT

A firing head assembly may include a tubular housing; a valve slidably disposed within the tubular housing; a lock mandrel disposed in the tubular housing between the valve and the tubular housing second end; a firing pin holder disposed in the tubular housing between the lock mandrel and the tubular housing second end; an engagement mechanism operably contacting the lock mandrel and the firing pin holder latch. The valve may have a piston end exposed to the lumen. The lock mandrel may be restrained from axial movement by a shear element. The firing pin holder may include a firing pin and latch. The engagement mechanism may be switchable between an engaged arrangement and a disengaged arrangement. The engagement mechanism may be configured to transition from the engaged arrangement to the disengaged arrangement in response to an axial movement of the lock mandrel.

19 Claims, 10 Drawing Sheets

Related U.S. Application Data

(60) Provisional application No. 62/865,527, filed on Jun. 24, 2019, provisional application No. 62/775,545, filed on Dec. 5, 2018.

(58) Field of Classification Search
CPC .... E21B 23/065; E21B 34/102; E21B 34/103; E21B 34/14; E21B 34/142; E21B 43/1185; E21B 43/11852; E21B 43/11855
See application file for complete search history.

(56) References Cited

U.S. PATENT DOCUMENTS

| | | | | |
|---|---|---|---|---|
| 4,527,629 | A | 7/1985 | Whitley et al. | |
| 4,544,034 | A | 10/1985 | George | |
| 4,566,538 | A * | 1/1986 | Peterson | E21B 33/1295 166/278 |
| 4,581,919 | A | 4/1986 | Sullivan | |
| 4,648,470 | A | 3/1987 | Gambertoglio | |
| 4,678,044 | A * | 7/1987 | Luke | E21B 43/11852 175/4.54 |
| 4,690,227 | A | 9/1987 | George et al. | |
| 4,862,964 | A | 9/1989 | George et al. | |
| 4,880,056 | A | 11/1989 | Nelson et al. | |
| 4,911,251 | A | 3/1990 | George et al. | |
| 4,917,189 | A | 4/1990 | George et al. | |
| 4,969,525 | A | 11/1990 | George et al. | |
| 5,161,616 | A | 11/1992 | Colla | |
| 5,490,563 | A | 2/1996 | Wesson et al. | |
| 5,505,261 | A * | 4/1996 | Huber | E21B 43/116 166/151 |
| 5,603,384 | A | 2/1997 | Bethel et al. | |
| 5,680,905 | A | 10/1997 | Green et al. | |
| 5,908,365 | A * | 6/1999 | LaJaunie | E21B 43/11852 166/299 |
| 5,911,277 | A | 6/1999 | Hromas et al. | |
| 6,035,880 | A | 3/2000 | Gazda | |
| 6,102,126 | A | 8/2000 | Huber et al. | |
| 6,220,370 | B1 | 4/2001 | Wesson et al. | |
| 6,722,424 | B2 | 4/2004 | Broad | |
| 7,635,027 | B2 | 12/2009 | Rankin et al. | |
| 8,006,779 | B2 | 8/2011 | Moore et al. | |
| 8,061,431 | B2 | 11/2011 | Moore et al. | |
| 8,393,392 | B2 | 3/2013 | Mytopher et al. | |
| 8,453,729 | B2 | 6/2013 | Harris et al. | |
| 8,499,826 | B2 | 8/2013 | Hillis et al. | |
| 8,763,507 | B2 * | 7/2014 | Ross | E21B 43/11852 137/68.17 |
| 8,851,160 | B2 | 10/2014 | Stolboushkin | |
| 8,910,556 | B2 | 12/2014 | Umphries et al. | |
| 8,991,496 | B2 | 3/2015 | Bishop | |
| 9,347,268 | B2 | 5/2016 | Grigor et al. | |
| 9,476,290 | B2 * | 10/2016 | Umphries | E21B 43/11855 |
| 9,540,913 | B2 | 1/2017 | Moore | |
| 9,689,232 | B2 | 6/2017 | Hardesty et al. | |
| 9,689,240 | B2 | 6/2017 | LaGrange et al. | |
| 10,753,184 | B2 * | 8/2020 | LaGrange | E21B 43/11852 |
| 10,934,815 | B2 * | 3/2021 | LaGrange | E21B 43/1185 |
| 11,156,067 | B2 * | 10/2021 | Henke | F42D 1/06 |
| 11,174,713 | B2 * | 11/2021 | Brady | E21B 43/11852 |
| 2003/0062153 | A1 | 4/2003 | Broad | |
| 2010/0206633 | A1 | 8/2010 | Moore et al. | |
| 2011/0088946 | A1 | 4/2011 | Moore et al. | |
| 2012/0145403 | A1 * | 6/2012 | Hillis | E21B 47/18 166/321 |
| 2013/0098616 | A1 * | 4/2013 | Ross | E21B 43/11852 166/321 |
| 2014/0137723 | A1 * | 5/2014 | Umphries | E21B 43/11852 89/1.15 |
| 2015/0247389 | A1 * | 9/2015 | Umphries | E21B 34/12 166/55 |
| 2016/0273307 | A1 | 9/2016 | Evertsen | |
| 2019/0048693 | A1 | 2/2019 | Henke et al. | |
| 2019/0353014 | A1 * | 11/2019 | LaGrange | E21B 43/1185 |
| 2019/0353015 | A1 * | 11/2019 | LaGrange | E21B 43/1185 |
| 2020/0182025 | A1 | 6/2020 | Brady | |
| 2022/0034207 | A1 * | 2/2022 | Brady | E21B 43/11852 |

FOREIGN PATENT DOCUMENTS

| | | | | |
|---|---|---|---|---|
| CN | 108150134 | A | 6/2018 | |
| CN | 108979582 | A | 12/2018 | |
| EP | 0404686 | B1 | 4/1994 | |
| GB | 2054107 | A * | 2/1981 | E21B 43/11852 |
| GB | 2150267 | A * | 6/1985 | E21B 43/116 |
| GB | 2150267 | A | 6/1985 | |
| GB | 2290128 | A | 12/1995 | |
| GB | 2511632 | B | 7/2017 | |

OTHER PUBLICATIONS

International Searching Authority; International Search Report and the Written Opinion of the International Searching Authority; dated Feb. 24, 2020; 13 pages.

Oiltech Services Pte. Ltd., TCP Firing Heads & Accessories, Direct Hydraulic Firing System, Jan. 9, 2017, 3 pgs.,http://www.technotrade.com.tr/assets/Uploads/Tubing-Conveyed-Perforating/Direct-Hydraulic-Firing-System.pdf.

* cited by examiner

FIRING HEAD AND METHOD OF UTILIZING A FIRING HEAD

CROSS-REFERENCE TO RELATED APPLICATIONS

This application is a continuation of U.S. application Ser. No. 16/695,729 filed Nov. 26, 2019, which claims the benefit of U.S. Provisional Application No. 62/775,545, filed Dec. 5, 2018 and U.S. Provisional Application No. 62/865,527, filed Jun. 24, 2019, each of which is incorporated herein by reference in its entirety.

BACKGROUND OF THE DISCLOSURE

In the extraction of hydrocarbons such as fossil fuels and natural gas from underground wellbores extending deeply below the surface, complex machinery and explosive devices are utilized. It is common practice to facilitate the flow of production fluid by perforating a fluid bearing subterranean formation using a perforating gun, which is lowered into the wellbore to the depth of the formation and then detonated to form perforations in the formation surrounding the perforating gun. A firing head assembly is coupled to the gun and it is the firing head assembly which fires the gun. The firing head assembly may be coupled to the perforating gun before the gun is lowered into the wellbore. It is typically preferred for safety and other reasons, to initiate the firing head only after the gun is positioned in the wellbore. A firing head is designed initiate the detonating cord in the perforating gun after the initiator portion of the firing gun assembly receives an appropriate command from the surface.

It is important that the firing head used to initiate explosives in a perforating gun be reliable and safe in operation. There have been numerous accidents resulting in severe injury or death where an explosive well tool, such as a perforating gun, fires prematurely at the surface of a wellbore while personnel are rigging the tool in preparation for running it into the wellbore. Utilizing an electrical signal, whether conveyed by a wire or wirelessly, presents a number of difficulties, particularly from a safety standpoint. With so many moving metal parts and unknowns regarding factors such as the geological conditions of the well, opportunities exist for stray voltage. As such, the need exists for a failsafe means to prevent accidental triggering of explosive or pyrotechnic elements.

There are many reasons for an operator or personnel to decide not to fire a perforating gun that has been run into the wellbore. Such reasons include problems with running the perforating gun into the wellbore (i.e., running in hole), problems with other completion equipment, or problems with the perforating gun assembly or its related components. Another potential risk is that after the firing procedure is performed, there is no positive indication that the perforating gun actually fired. Such situations may result in live explosives/shaped charges returning to the surface of the wellbore. This, of course, is a danger to all personnel and equipment present at the surface when the perforating guns are retrieved.

Once the wellbore is established by placement of cases after drilling, a perforating gun assembly, or train or string of multiple perforating gun assemblies, are lowered into the wellbore and positioned adjacent one or more hydrocarbon reservoirs in underground formations. With reference to FIG. 1, a typical perforating gun assembly 40, (shown herein as a tubing conveyed perforating gun commercially available from DynaEnergetics GmbH & Co. KG), is depicted in which explosive/perforating charges 46, typically shaped, hollow, or projectile charges, may be detonated to create holes in the casing and to blast through the formation so that the hydrocarbons can flow through the casing and formation.

As shown in the embodiment of FIG. 1, the perforating gun assembly 40 includes a gun casing or carrier or housing 48, within which various components are connected, ("connected" means screwed, abutted, snap-fit and/or otherwise assembled). At one end of the perforating gun assembly 40 of FIG. 1, a firing head 41 houses a piston 42 and a percussion initiator 10. The firing head 41 is connected to a top sub 45, and the top sub 45 houses a booster 43 and a detonating cord 44. The top sub 45 is connected to the gun housing 48, which houses an inner charge tube, strip, or carrying device 47, which houses one or more of the charges 46. The detonating cord 44 makes a connection with each of the charge(s) 46. Between the firing head 41 and a tandem sub, one or more time delay subs may be positioned.

Once the perforating gun(s) is properly positioned, the piston 42 is accelerated by hydraulic pressure or mechanical impact, which in turn initiates the percussion initiator 10, which initiates the booster 43 to initiate the detonating cord 44. The detonating cord 44 detonates the shaped charges 46 to penetrate/perforate the casing and thereby allow formation fluids to flow through the perforations thus formed and into a wellbore.

In another assembly of the prior art as shown in FIG. 2, the firing head 41 that is preferably used between perforating gun assemblies and connected using a detonating cord and booster (as shown, for instance in FIG. 1), houses an alignment insert 4 on one end to which a firing pin housing 3 is connected. The firing pin housing 3 contains a firing pin 2 and is connected to an igniter support 6, which in turn houses an igniter or energetic material 5. In this assembly, initiation of the booster (not shown in FIG. 2) is used to accelerate the firing pin 2, which in turn initiates the igniter 5, which will either initiate the booster to initiate the detonating cord which detonates shaped charges in an adjacent gun or will initiate a time delay which activates one perforating gun assembly in the tool string of connected guns. As mentioned above, conventional perforating systems may provide for a pyrotechnic time delay device located within or adjacent the firing head 41. The pyrotechnic time delay device interposes a time delay between the initiation of the firing head 41 and the firing of the charges 46 carried by the perforating gun assembly 40.

In oil and gas wells, it is often necessary to either reduce or stop the flow of fluid through a wellbore. Alternatively, it is sometimes necessary to stop or reduce fluid flow in one direction while allowing fluid flow in the other direction. Tools which stop the flow of fluid in a wellbore, whether in one or both directions, are called frac plugs. A frac plug has several functional purposes. First, it travels through the wellbore to a desired position for 'setting' the frac plug. A firing head is often used in combination with a frac plug. That is, the firing head is used to place and activate a frac plug tool in the oil and gas well.

In view of continually increasing safety requirements and the problems described hereinabove, there is a need for a firing head assembly that facilitates safe and consistent initiation of shaped charges in a perforating gun as well as other pyrotechnic/explosive components contained in a wellbore tool or tool string. There is also a need for a firing head assembly for use in a perforating gun or a tool string that reduces the risk of property damage and bodily harm, including death, in a firing condition. Furthermore, there is a need for a firing head assembly having a safety feature that will not allow the perforating gun or other tool to fire unless an operator performs particular steps showing a deliberate desire to fire the perforating gun or tool. Additionally, there is a need for a firing head assembly that allows an operator to abort a firing operation in a manner that prevents firing of the perforating gun or tool.

BRIEF DESCRIPTION OF THE EXEMPLARY EMBODIMENTS

According to an embodiment, a firing head assembly may include a tubular housing having a first end, a second end and a lumen extending between the first end and the second end and a valve slidably disposed within the tubular housing. The valve may include a piston end exposed to the tubular housing lumen. A lock mandrel is also disposed in the tubular housing between the valve and the tubular housing second end. The lock mandrel may include a proximal end, a shaft, a distal end and a groove formed in the shaft adjacent the distal end. The lock mandrel may be restrained from axial movement within the tubular housing by one or more lock mandrel shear elements. The tubular housing also contains a firing pin holder between the lock mandrel and the tubular housing second end. The firing pin holder may include a firing pin and a latch. A percussion initiator is also part of the firing head assembly and is configured to be activated by the firing pin. An engagement mechanism operably contacts the distal end of the lock mandrel and the firing pin holder latch. The engagement mechanism has an engaged arrangement and a disengaged arrangement. The engaged arrangement restrains the firing pin holder from axial movement relative to the firing head assembly and the disengaged arrangement permits movement of the firing head assembly. Transition from the engaged arrangement to the disengaged arrangement occurs as the result of an axial movement of the lock mandrel permitting the engagement mechanism to enter the groove and no longer engage the firing pin holder latch.

The firing head assembly may also include at least one valve restraining element, e.g., a shear element or biasing element, configured to prevent axial movement of the valve. An operator-controlled force exerted on the valve overcomes the valve restraining element and causes the valve to move axially toward the lock mandrel. In addition, one or more fluid holes may be provided through the tubular housing adjacent the firing pin holder and exposing a portion of the firing pin holder to a pressure condition existing external to the tubular housing. The firing pin will only activate the percussion initiator when the pressure condition external to the tubular housing is approximately that found in a wellbore, e.g., a pressure substantially higher than atmospheric pressure.

According to an embodiment, a method is disclosed for activating a percussion initiator utilizing a firing head disposed in a tubular housing, the tubular housing having a first end, a second end and a lumen extending between the first end and the second end. The method comprises pumping fluid into the first end of the tubular housing, the fluid exerting a fluid pressure on a valve that is slideably disposed in the tubular housing lumen. The valve is moved axially toward the second end of the tubular housing as a result of the fluid pressure. A lock mandrel is restrained from axial movement within the tubular housing with a restraining element, the lock mandrel being disposed in the tubular housing lumen between the valve and the tubular housing second end. The lock mandrel includes a proximal end, a shaft, a distal end and a groove formed in the shaft adjacent the distal end. A force is exerted on the proximal end of the lock mandrel by movement of the valve, this force being sufficient to overcome the restraining element. A latch portion of a firing pin holder is contacted with an engagement mechanism, the firing pin holder includes a firing pin and is disposed in the tubular housing between the lock mandrel and the tubular housing second end. The contact between the latch portion and the engagement mechanism prevents axial movement of the firing pin holder. The distal end of the lock mandrel is shifted as a result of the force exerted on the lock mandrel by movement of the valve. The engagement mechanism is disengaged from the latch portion of the firing pin holder by the shift of the distal end of the lock mandrel and the percussion initiator is activated by moving the firing pin holder and causing the firing pin to strike the percussion initiator.

The firing head assembly may include a reduced diameter section of the drive sleeve and the valve may include a sealing end sized to sealingly slide through the reduced diameter section. The piston end of the valve is sized so as to sealingly slide through the valve sleeve and be restrained from axial movement past the reduced diameter section by a valve seat. With this structural arrangement, the operator-controlled force from the valve to the valve sleeve is transmitted from the valve to the valve seat.

The valve sleeve of the firing head may also include a sealable lumen located between the reduced diameter section and an interior end of the valve sleeve adjacent the lock mandrel head. An annulus may be defined by the piston end of the valve, a body portion of the valve between the piston end and the sealing end, the reduced diameter section of the valve sleeve and an inner wall of the valve sleeve. The piston end of the valve may include an entrance exposed to the tubular housing lumen and piston end circulating holes in fluid communication with the entrance and the annulus. The sealing end of the valve may include sealing end circulating holes in fluid communication with the sealable lumen. In such an arrangement, axial movement of the valve in the valve sleeve results in a circulating position and a sealed position. In the circulating position, the sealing end circulating holes are in fluid communication with the annulus and in the sealed position the reduced diameter section of the valve sleeve seals the sealing end circulating holes from fluid communication with the annulus.

The operator-controlled force of the firing head assembly may be exerted by a pump controlled by the operator, the pump increasing the pressure of a fluid in a tube fluidly connected to the pump and the tubular housing first end. The circulating position of the valve may allow fluid communication through each of the tube, tubular housing lumen, annulus and sealable lumen of the valve and the sealed position of the valve prevents fluid communication from the annulus to the sealed lumen of the valve.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
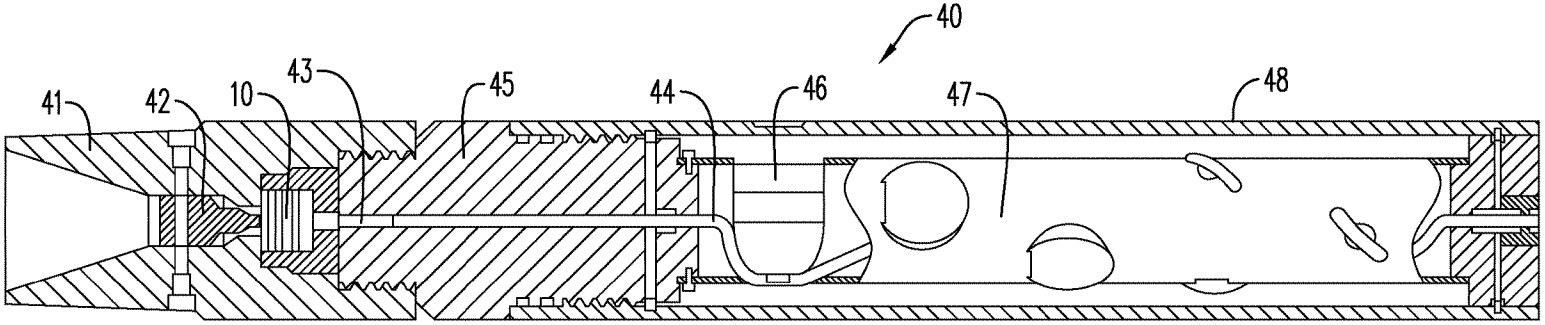
FIG. 1 (PRIOR ART)
FIG. 1 is a cross-sectional plan view of a prior art perforating gun assembly.
Figure 2:
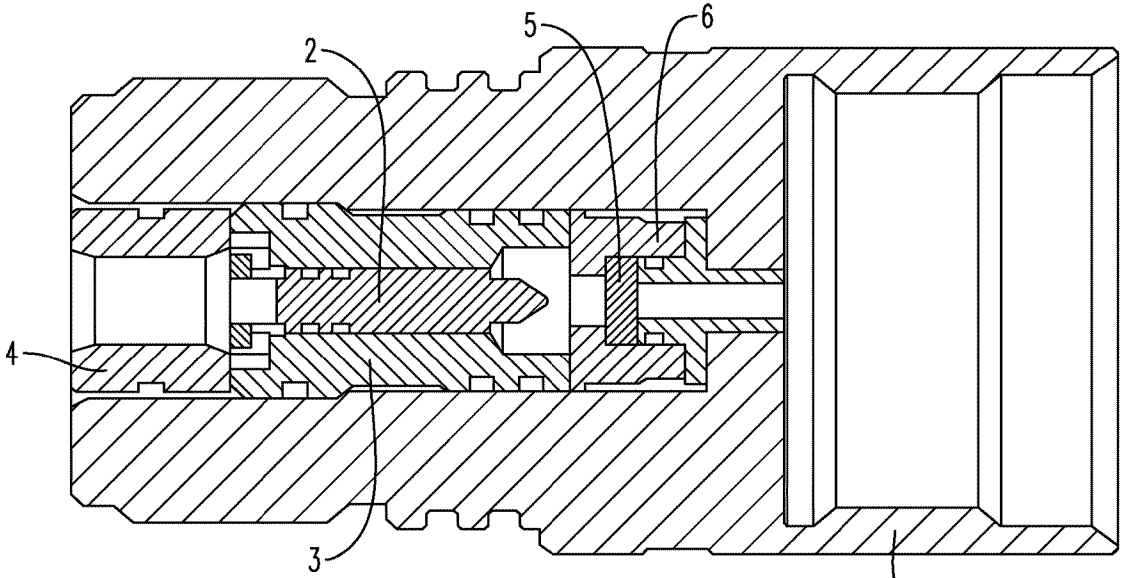
FIG. 2 (PRIOR ART)
FIG. 2 is a cross-sectional plan view of a prior art firing head.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Figure 3:
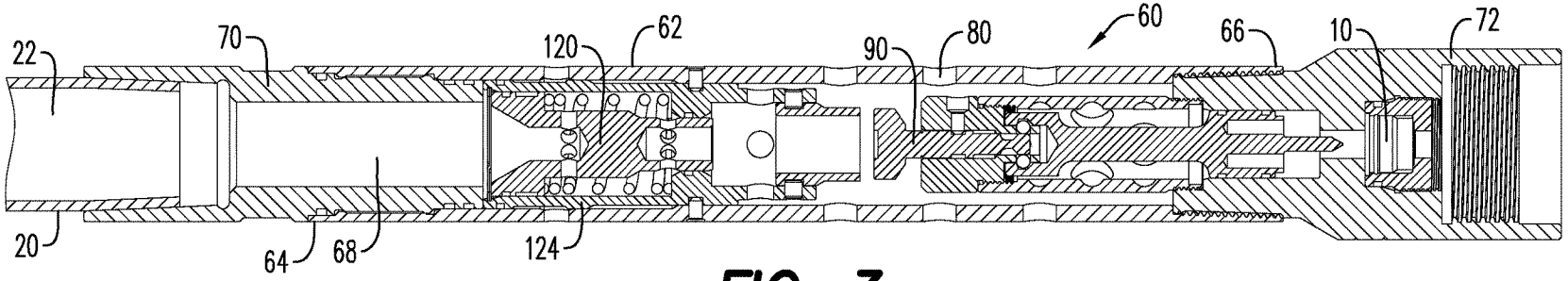
FIG. 3 is a cross-sectional plan view of a differential flow rate firing head according to an embodiment.

FIG. 3 shows an exemplary embodiment in which a string of tools for performing multiple downhole functions in a well is designed to be attached to end of tubing 20 and lowered into a well casing. The central lumen 22 of tubing 20 may be used to convey fluid from outside the well, i.e., from a wellhead at the surface, down to the tool string. This fluid conveyance ability also means that altered flow rates and pressures exerted on the fluid in the portion of lumen external to the well will be conveyed to the tool string. The tool string may be provided with a firing head assembly 60 arranged to only detonate an associated tool once certain elevated pressure conditions are sent to firing head assembly 60 by an operator utilizing tubing 20.

In an embodiment shown in FIG. 3, firing head assembly 60 has a tubular housing 62 defining a central lumen 68 extending the length of the housing 62 from a first end 64 to a second end 66. A top sub 70 may be attached to or integral with the first end 64 of housing 62 and adapted to allow connection to tubing 20. Top sub 70 also conveys fluid and, thus, alterations in flow rate and pressure from tubing 20 to central lumen 68 of firing head housing 62.

A bottom sub 72 may be attached to or integral with the second end 66 of the housing 62. In an embodiment, the bottom sub 72 is adapted to allow connection to a perforating gun assembly 40 or other tool used in a wellbore. The bottom sub 72 may also include a percussion initiator 10 and a firing pin 76, shown in FIG. 4. The firing pin 76 will strike the percussion initiator 10 with sufficient force to result in activation of the percussion initiator 10. Depending upon the details of the percussion initiator selected, activation will mean initiation, ignition, detonation, or similar result. Some portion of the wellbore tool exposed to the activation of the percussion initiator 10 will then ignite/detonate. In the event that the bottom sub 72 is connected to a perforating gun assembly 40, activation of the percussion initiator 10 results in ignition of a detonating cord 44; the ignition will proceed along the detonating cord 44 and detonate the perforating charges 46. Alternatively, the bottom sub 72 may be connected to a setting tool (not shown). In this circumstance, the percussion initiator 10 will initiate deflagration of a power charge in the setting tool. Essentially any function served by a percussion initiator 10 in a downhole tool can utilize the firing head 60 assembly embodiments described herein.

In an embodiment, the firing head assembly 60 retains the firing pin 76 regardless of any circumstance that might result in releasing the firing pin 76 other than a deliberate desire on the part of the operator to cause such a release. That is, accidental release of the firing pin 76 is prevented under all conceivable circumstances. The firing head assembly 60 only releases the firing pin 76 in response to the operator performing a deliberate operation that is extremely unlikely to occur accidentally. The deliberate operation performed by the operator is conveyed to the firing head assembly 60. The firing pin 76 is released to strike percussion initiator 10 only upon receipt of the deliberate operation by the firing head assembly 60. To the greatest extent possible, release of the firing pin 76 will not occur as a result of any other operation, force or condition to which the firing head assembly 60 is subjected. In other words, an important function of a firing head is to achieve extremely reliable retention of firing pin 76 and, when so desired, equally reliable release of firing pin 76 when desired by the operator. Said reliability is extremely important to the safe and effective operation of the firing head assembly 60 and its associated wellbore tool(s).

Figure 4:
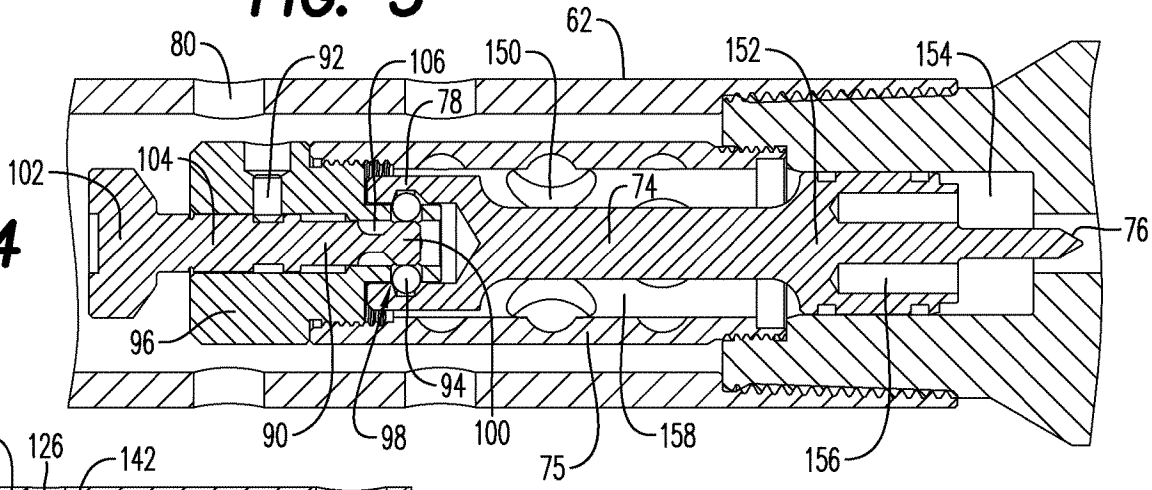
FIG. 4 is a cross-sectional detail plan view of the lock mandrel and firing pin end of the differential flow rate firing head of FIG. 3.

FIG. 4 illustrates an exemplary embodiment of a structure to achieve the function of retaining the firing pin 76 under all conceivable circumstances prior to deliberate intent on part of operator to release it. This is achieved by the lock mandrel housing 96, the lock mandrel housing latch 98, the latch ball bearings 94, the firing pin holder 74 and the firing pin holder latch 78. The lock mandrel housing 96 is immovable with respect to the housing 62 of the firing head assembly 60. This may be achieved by the threaded attachment of the lock mandrel housing 96 to the firing pin housing 75 because the firing pin housing 75 is connected to the housing 62 of the firing head assembly 60 through the bottom sub 72. The mandrel housing 96 includes a mandrel housing latch 98 which engages the firing pin holder latch 78 and renders the firing pin holder 74 immovable with respect to the firing head assembly housing 62. That is, the firing pin holder 74 cannot move as long as the mandrel housing latch 98 and the firing pin holder latch 78 are engaged. In the embodiment shown in FIG. 4, the latch ball bearings 94 are the engagement mechanisms that prevent movement of the firing pin holder 74. As long as the latch ball bearings 94 are in the position shown in FIG. 4, they prevent the firing pin holder 74 from moving relative to the firing head assembly housing 62. Lock mandrel distal end 100 is sized to assure that the latch ball bearings 94 remain engaged with the firing pin holder latch 78 and the mandrel housing latch 98.

FIG. 4 also illustrates much of the structure that achieves the function of releasing the firing pin holder 74 and the firing pin 76 when the operator intends to initiate detonation. As noted above, the lock mandrel distal end 100 prevents radial movement of the latch ball bearings 94. Located on a section of a lock mandrel shaft 104 adjacent the distal end 100 is a lock mandrel groove 106, which is sized to accommodate the latch ball bearings 94. If the lock mandrel 90 is shifted a sufficient distance in the axial direction, the latch ball bearings 94 are permitted to drop radially into the lock mandrel groove 106. After moving into the lock mandrel groove 106, the latch ball bearings 94 are no longer acting as engagement mechanisms preventing movement of the firing pin holder 74. Thus, firing pin holder 74 and attached firing pin 76 are free to move in the axial direction.

The lock mandrel 90 is prevented from axial movement by the lock mandrel shear pin 92. A portion of the lock mandrel shear pin 92 extends radially into the lock mandrel shaft 104 and another portion of the shear pin 92 extends into a sidewall of the lock mandrel housing 96. As with any shear pin, the materials and dimensions of the lock mandrel shear pin 92 are selected such that a sufficient level of shear force exerted on the shear pin 92 will cause the pin to shear. Since the shear pin 92 prevents axial movement of the lock mandrel 90 with respect to the lock mandrel housing 96, an axial force exerted on the lock mandrel 90 will result in a shear force on the shear pin 92; sufficient axial force on the lock mandrel 90 will cause the shear pin 92 to fail, i.e., shear, and allow relative axial movement of the lock mandrel 90 and the lock mandrel housing 96. As previously recognized, axial movement of the lock mandrel shaft 104 allows the lock mandrel groove 106 to receive the latch ball bearings 94 which, in turn, permits axial movement of firing pin holder 74 and attached firing pin 76.

FIG. 4 also shows a firing pin housing 75 surrounding the firing pin holder 74 and provided with circulating holes 150. A firing pin housing lumen 158 between the firing pin housing 75 and the tubular housing 62 will be at the same pressure as the shear bushing lumen 148 and the firing pin housing circulating holes 150 allow this pressure to enter the firing pin housing lumen 158. A firing pin piston 152 sealingly separates the firing pin housing lumen 158 from an air chamber 154. Upon the latch ball bearings 94 releasing the firing pin holder 74, a significant pressure differential may exist between the pressurized fluid in the firing pin housing lumen 158 and the relatively unpressurized air contained in the air chamber 154. Such a pressure differential will cause the firing pin holder 74 to slide axially and drive the firing pin 76 into the percussion initiator 10 with significant force. Also of note, the firing pin piston 152 compresses the air in air chamber 154 as the firing pin 76 advances toward percussion initiator 10. As the air is compressed, it will begin to resist movement of the firing pin piston 152 and may prevent the firing pin 76 from striking the percussion initiator 10 with sufficient force. One or more air spring arrestors 156 are provided to increase the volume of air being compressed and, thus, reduce the compressed air resisting force developed in the air chamber 154.

An important safety feature of the embodiment illustrated in FIGS. 3-8 bears further explication. In the absence of significant fluid pressure in the firing pin housing lumen 158, the firing pin holder 74 and firing pin 76 will not move, at least not with sufficient force to activate the percussion initiator 10. That is, if the latch ball bearings 94 release the firing pin holder 74 under conditions where a significant pressure differential does not exist between the pressurized fluid in the firing pin housing lumen 158 and the air contained in the air chamber 154, the firing pin holder 74 will not drive the firing pin 76 into the percussion initiator 10, at least not with great enough force to activate it. Thus, accidental disengagement of the ball bearings 94 from the firing pin holder 74 will not result in accidental activation of the percussion initiator 10 under most circumstances. Significant pressure outside the firing head assembly 60 and inside the firing pin housing lumen 158, which are coupled through the firing pin housing circulating holes 150, are a condition precedent to driving the firing pin 76 with sufficient force to activate the percussion initiator 10. This is a significant safety advantage.

Figure 5:
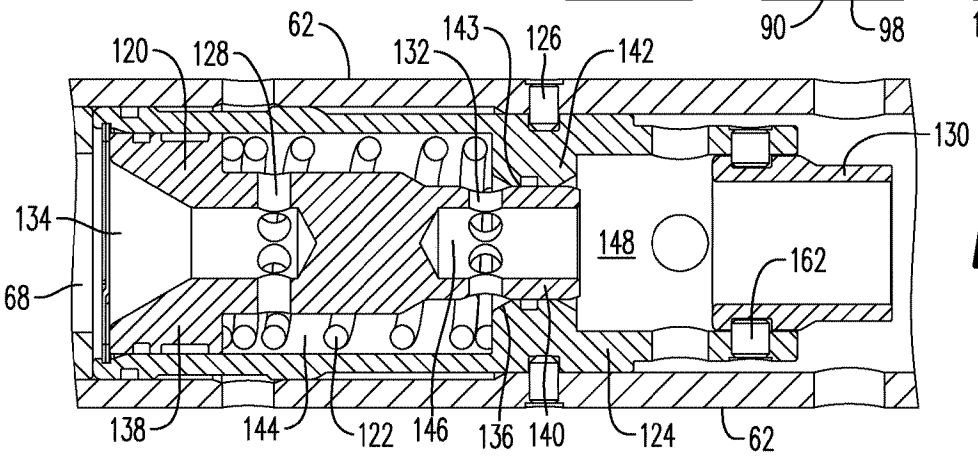
FIG. 5 is a cross-sectional detail plan view of the circulation valve and valve sleeve end of the differential flow rate firing head of FIG. 3.

The embodiment shown in FIG. 5 presents a structure through which an operator at ground level may cause a sufficient axial force to be placed on the head 102 of the lock mandrel 90 to begin the process, described hereinabove, that results in the firing pin 76 striking the percussion initiator 10. A circulating valve 120 is disposed in a valve sleeve 124 which, in turn, is disposed in the central lumen 68 of the tubular housing 62. This tubular housing 62 is that of the firing head assembly 60 shown in FIG. 3. Some axial movement of the valve sleeve 124 within the tubular housing 62 is permitted, as is some axial movement of the circulating valve 120 within an axial lumen of the valve sleeve 124. One or more valve sleeve shear pins 126 are received in the outer wall of the valve sleeve 124 and the inner wall of the tubular housing 62. Similar to the shear pins described previously, the valve sleeve shear pins 126 prevent axial movement of the valve sleeve 124 relative to the tubular housing 62. An axially directed force exerted on the valve sleeve 124 will result in shear force being exerted on the shear pins 126. The dimensions and materials of the valve sleeve shear pins 126 are selected such that a threshold axial force exerted on the valve sleeve 124 will cause the shear pins 126 to shear. Once the shear pins 126 fail, the valve sleeve 124 moves axially with respect to the tubular housing 62.

The end of the valve sleeve 124 adjacent the lock mandrel 90 has a shear bushing 130 connected thereto that will travel axially along with the valve sleeve 124. As seen in FIG. 3, movement of valve sleeve 124 axially toward lock mandrel 90 results in the shear bushing 130 striking the lock mandrel head 102 and exerting an axial force on the lock mandrel 90. With sufficient force, the lock mandrel shear pin 92 will shear and result, as described hereinabove, in the firing pin 76 striking the percussion initiator 10. Additional structural detail regarding the shear bushing 130 will be provided hereinbelow.

The circulating valve 120, as seen in FIG. 5, has a piston end 138 and a sealing end 140. The piston end 138 is closer to the first end 64 of the tubular housing 62. A biasing member 122, such as a coil spring, pushes the piston end 138 toward the first end 64 of the housing 62. The outer walls of the piston end 138 are in a substantially sealed relationship with the inner walls of the valve sleeve 124, which sealed relationship may be augmented with o-rings (not shown). The piston end 138 has a tapered circulating valve entrance 134 exposed to the central lumen 68 of the housing 62. The piston end 138 also has circulating holes 128 that allow fluid passing from the housing central lumen 68, through the circulating valve entrance 134, through the piston end circulating holes 128 and into a circulating valve annulus 144.

The sealing end 140 of the circulating valve 120 is of lesser diameter than the piston end 138 and passes through a reduced diameter portion 142 of the valve sleeve 124. A valve seat 136 is formed on the reduced diameter portion 142 of the valve sleeve 124 and supports the piston end 138 biasing member 122; neither the piston end 138 nor the biasing member 122 can pass the reduced diameter portion 142. The outer walls of the sealing end 140 and the inner walls of the reduced diameter portion 142 of the valve sleeve 124 establish a sealed interface 143, the sealed interface 143 may be augmented with o-rings (not shown). Sealing end circulating holes 132 provide fluid communication from the circulating valve annulus 144, through a central lumen 146 of the sealing end 140 and into the shear bushing lumen 148.

Under passive conditions, shown in FIGS. 3-5, the circulating valve 120 is biased toward the first end 64 of the tubular housing 62 by the biasing member 122. Fluid from the tubing 20 is able to flow through the central lumen 22 of the tubing 20, into the tubular housing lumen 68 and is able to flow freely through the circulating valve 120. That is, flow through the sealing end circulating holes 132 and the piston end circulating holes 128. Since the fluid pressure adjacent the piston end 138 and the sealing end 140 of the circulating valve 120 are approximately equal, little to no axial forces are acting on the circulating valve and, as stated above, the biasing member 122 holds the circulating valve 120 in place.

The tubular housing 62 is provided with a plurality of fluid holes 80 between the valve sleeve 124 and the second end 66 of the firing head assembly 60. Fluid passing completely through the circulating valve 120 and the valve sleeve 124 will exit the firing head assembly 60 through the fluid holes 80 and into the wellbore.

One function of tubing 20 is to convey fluid through its central lumen 22 from the surface to the tool string. Various valves, pumps, containers and associated apparatus permit an operator to pump fluid down into a wellbore at controlled flow rates and pressures. In an embodiment, the central lumen 22 of the tubing 20 conveys this fluid to the firing head assembly 60. Thus, an operator possesses a means to pump fluid through tubing 20 to the firing head assembly 60. Thus, the somewhat related parameters of flow rate and pressure at the surface and at the first end 64 of tubular housing 62 are under operator control. Flow rate is the volume (usually barrels or gallons) of fluid pumped into the tubing 20 per unit time. Increased pumping pressure, controlled by the operator, increases the flow rate through tubing 20 and, typically, the fluid pressure.

The first significant restriction to fluid flow through the tubing 20 and into the lumen 68 of the tubular housing 62 of firing head assembly 60 is the circulating valve 120 and valve sleeve 124. Fluid pumped through tubing 20 must pass through the relatively restricting structures of the circulating valve 120 and the valve sleeve 124 before being able to pass through the holes 80 and into the wellbore. As the flow rate of fluid through the tubing 20 increases, the restrictions presented by the valve 120 and the valve sleeve 124 result in a pressure differential. That is, the fluid pressure on the piston end 138 of the circulating valve 120 becomes progressively greater than the fluid pressure on the sealing end 140. Therefore, as the operator increases the fluid flow rate, the pressure differential across the circulating valve increases and the axial force on the piston end 138 overcomes the force exerted by the biasing member 122. The circulating valve 120 shifts axially within the valve sleeve 124 toward the second end 66 of the tubular housing 62. This shift eventually causes the sealing end circulating holes 132 to enter reduced the diameter section 142 of the valve sleeve 124. When this occurs, fluid in the circulating valve annulus 144 may no longer pass through the sealing end circulating holes 132 and, eventually, out the holes 80 into the wellbore.

The sealing off of the sealing end circulating holes 132 by axial shifting of the circulating valve 120 greatly increases the pressure differential across the circulating valve 120. This is because even the restricted flow through the piston end and the sealing end circulating holes 132, 134 has now been prevented from reaching the shear bushing lumen 148 and, thus, the pressure in the shear bushing lumen 148 quickly equilibrates to the wellbore pressure.

Figure 6A:
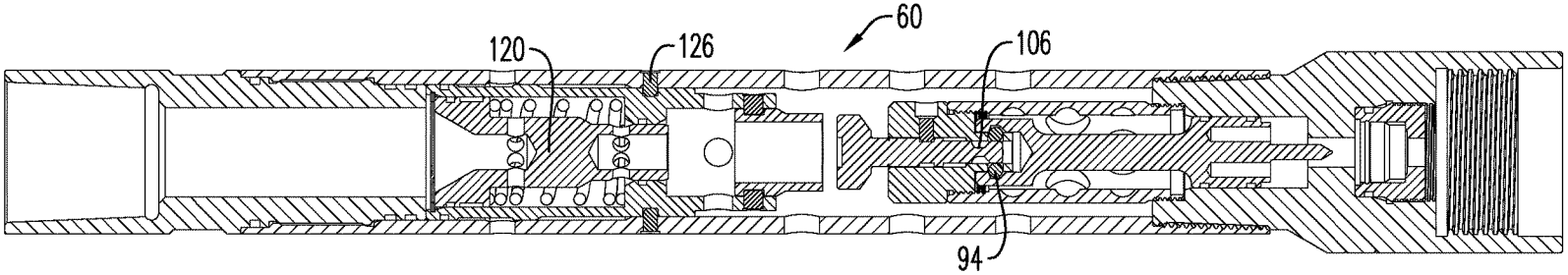
FIG. 6A is a cross-sectional plan view of the differential flow rate firing head of FIG. 3 in a free-circulation, locked mandrel condition.
Figure 6B:
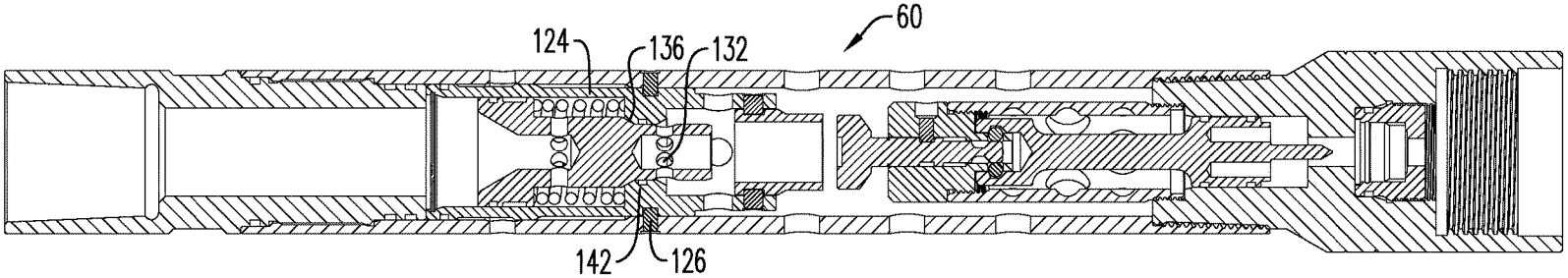
FIG. 6B is a cross-sectional plan view of the differential flow rate firing head of FIG. 3 in a closed-circulation, locked mandrel condition.

The above described firing head assembly 60 presents an embodiment through which an operator at ground level may cause the firing pin 76 to strike the percussion initiator 10. The process begins with the various components of firing head assembly 60 in the positions shown in FIG. 6A. The operator increases the fluid flow rate into the tubing 20, creating a pressure differential across the circulating valve 120. This pressure differential results in axial movement of the circulating valve 120, as shown in FIG. 6B, until sealing end circulating holes 132 are blocked off by the reduced diameter section 142 of the valve sleeve 124, thus greatly increasing the pressure differential across the circulating valve 120. The circulating valve 120 eventually abuts the valve seat 136 of the valve sleeve 124 and the entire axial force resulting from the pressure difference across the circulating valve 120 is exerted on the valve sleeve 124.

The valve sleeve 124 is restrained from axial movement within the tubular housing 62 by one or more valve sleeve shear pins 126. These shear pins 126 are received in the outer wall of the valve sleeve 124 and the inner wall of the tubular housing 62. The axial force resulting from the pressure differential across the circulating valve 120 and transferred to the valve sleeve 124 through the valve seat 136 is resisted by the shear pins 126. The operator may continue to increase the pressure in tubing 20 until the shear pins 126 can no longer resist the axial force, i.e., the shear pins 126 shear and no longer prevent axial movement of the valve sleeve 124.

Figure 6C:
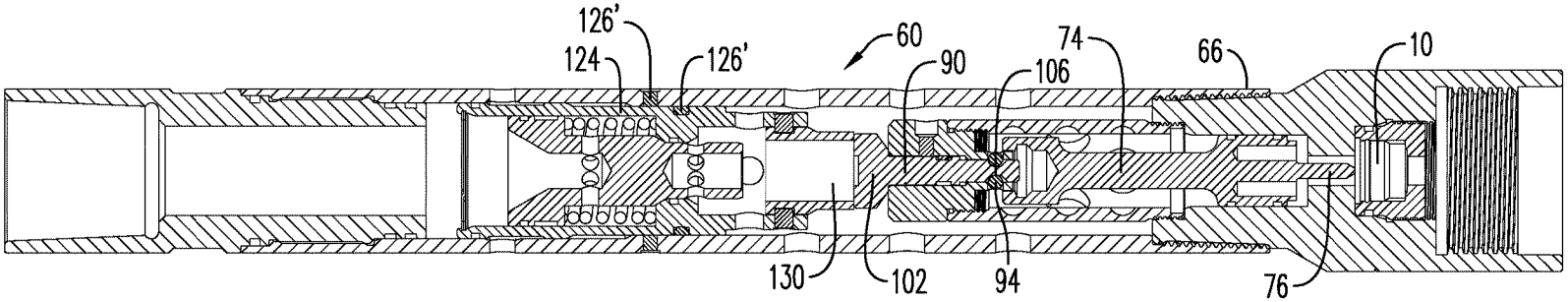
FIG. 6C is a cross-sectional plan view of the differential flow rate firing head of FIG. 3 in a closed-circulation, unlocked mandrel condition.

As shown in FIG. 6C, failed shear pins 126' no longer restrain the valve sleeve 124 and it has axially shifted toward the second end 66 of the tubular housing 62. This shift results in the shear bushing 130 striking the lock mandrel head 102 with sufficient force, as described previously, to shear the lock mandrel shear pin(s) 92. FIG. 6C also shows the lock mandrel 90 having shifted sufficiently to permit the latch ball bearings 94 to be received in the lock mandrel groove 106; the latch ball bearings 94 no longer prevent movement of the firing pin holder 74. Thus, the firing pin holder 74 has moved axially and caused the firing pin 76 to strike the percussion initiator 10.

Thus, the structures of the firing head assembly 60 described hereinabove allow the two primary functions of a firing head to be achieved in a highly predictable and controllable manner. That is, the firing pin 76 is reliably prevented from striking the percussion initiator 10 under any reasonably foreseeable circumstance other than the deliberate action of the operator and the firing pin 76 is reliably released upon the operator taking the deliberate action of substantially increasing the flow rate of fluid through the tubing 20.

Figure 7A:
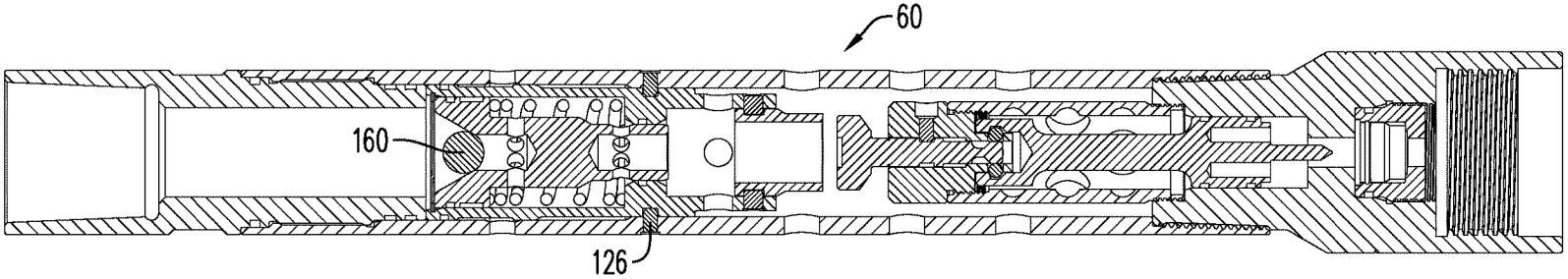
FIG. 7A is a cross-sectional plan view of the differential flow rate firing head of FIG. 3 in a free-circulation, locked mandrel condition with a drop-ball in place.
Figure 7B:
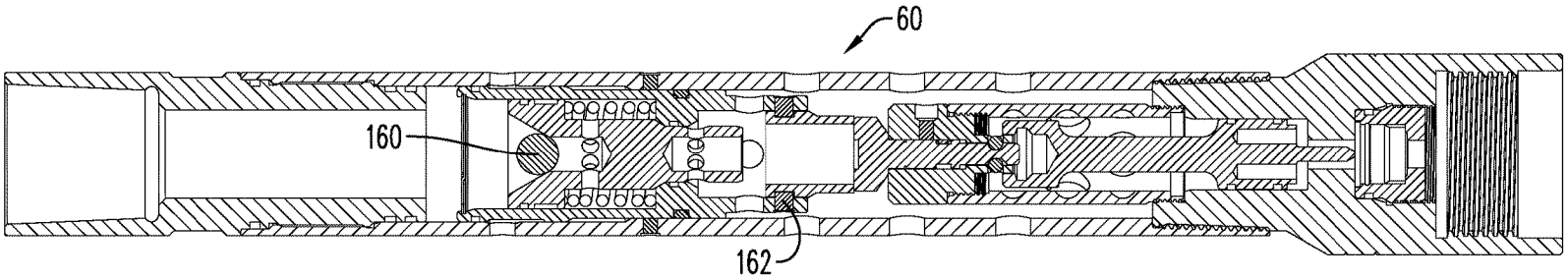
FIG. 7B is a cross-sectional plan view of the differential flow rate firing head of FIG. 3 in a closed-circulation, unlocked mandrel condition with a drop-ball in place.

FIGS. 7A and 7B show an alternative embodiment by which the operator may cause the firing pin 76 to be released. Alternatively, the exemplary embodiment shown in FIGS. 7A and 7B may be utilized in the event that increased flow rate through tubing 20 is insufficient to compress the biasing element 122 sufficiently to cause the sealing end circulating holes 132 to be sealed off in the reduced diameter section 142 of valve sleeve 124. This is because sealing end circulating holes 132 must be sealed off in order for a sufficient pressure differential to be developed across the circulating valve 120 to shear the valve sleeve shear pins 126. The operator has the option of introducing drop ball 160 into the tubing 20. Fluid flow will carry the drop ball 160 through the tubing 20 to the firing head assembly 60. The drop ball 160 will be dimensioned such that it will be received in the circulating valve entrance 134 and completely block any further fluid flow into the circulating valve 120. Upon seating in the circulating valve entrance 134, the drop ball 160 will cause a substantial pressure differential to build across the valve 120 in the same say that closing off the sealing end circulating holes 132 accomplished this function. Regardless of how much circulating valve 120 is shifted within the valve sleeve 124, the differential pressure across the valve 120 may be increased by the operator utilizing pumps until the valve sleeve shear pins 126 fail and release the valve sleeve for axial movement. Once this occurs, the valve sleeve bushing 130 will strike the lock mandrel head 102 and result, after several intervening actions such as described above, in the firing pin 76 striking the percussion initiator 10.

Whether subsequent to activating the percussion initiator 10 or otherwise, e.g., after failure of activation or if activation is aborted, it is advantageous to restore circulation through the firing head assembly 60 and other components of the tool string. After the process shown in FIGS. 6A, 6B and 6C, restoring circulation is typically achieved merely by reducing the pressure differential across the circulating valve 120, i.e., the operator can take steps to reduce the fluid pressure in the tubing 20. With reduction of the pressure differential across the valve 120, the biasing member 122 will typically push the valve 120 back toward the first end 64 of the tubular housing 62, thus unsealing the sealing end circulating holes 132. Once the holes 132 are again exposed to the circulating valve annulus 144, full circulation is restored to the firing head assembly 60.

It may develop that the biasing member 122 is unable to return the circulating valve 120 to its initial 'circulating' position, i.e., the circulating valve 120 is 'stuck' in the configuration of FIG. 6C or FIG. 7B. This is more likely to occur where the drop ball 160 is utilized but may occur whether or not this is the case. Regardless, if circulation is not returned to the firing head assembly then removal of the firing head assembly 60 and other components of the tool string is made more complicated. This is referred to as "pulling a wet tool string" and should be avoided whenever possible. As stated hereinbelow, additional structures associated with the shear bushing 130 allow return of circulation to the firing head assembly 60 even when unsealing the sealing end circulating holes 132 is not possible.

FIG. 6C and FIG. 7B show the firing head assembly 60 after activation of the percussion initiator 10. Circulation to the entirety of the firing head assembly 60 has not been restored in FIGS. 6C and 7B. The shear bushing 130 is restrained from axial movement with respect to the valve sleeve 124 by the bushing shear pins 162. These shear pins 162 are received in the inner wall of the valve sleeve 124 and the outer wall of the shear bushing 130. From the configuration of FIG. 6C or FIG. 7B, the operator may further increase the pressure differential across the circulating valve 120. The axial force resulting from the increased pressure differential across the circulating valve 120 will increase the force with which the shear bushing 130 is pushing against the lock mandrel head 102; this force is transmitted from the valve sleeve 124 to the shear bushing 130 through the shear pins 162. Once the differential pressure across the valve 120 reaches a certain level, the shear pins 162 will fail, at which point the shear bushing 130 will be able to slide into the shear bushing lumen 148 and the valve sleeve 124 will be able to shift further axially toward the second end 66 of the tubular housing 62. The shear bushing lumen 148 is encompassed by the valve sleeve 124 and may, for this reason, also be referred to as the sealable lumen 148 of the valve sleeve 124.

Figure 8:
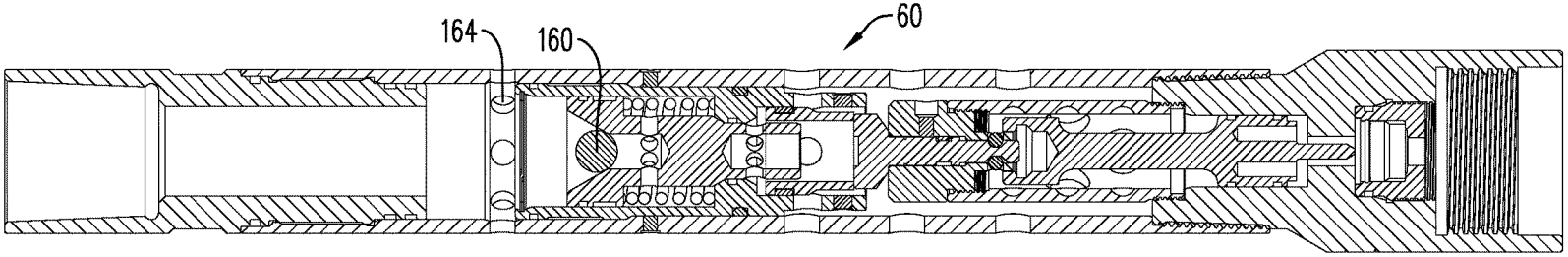
FIG. 8 is a cross-sectional plan view of the differential flow rate firing head of FIG. 3 in where circulation has been restored in situation where circulation could not be restored through the circulation valve.

FIG. 8 shows the firing head assembly 60 after the shear bushing 130 has slid into the shear bushing lumen 148 and the valve sleeve 124 has advanced as far axially as it possibly can. A set of circulation restoring holes 164 in the tubular housing previously blocked by the valve sleeve 124 are now exposed to the fluid pressure in the tubing 20 controlled by the operator. This tubing fluid may flow out the circulation restoring holes 164, through the annulus between the tubular housing 62 and the wellbore casing and back into the tubular housing through holes 80. Thus, fluid circulation throughout the firing head assembly 60 has been restored in FIG. 8.

Figure 9:
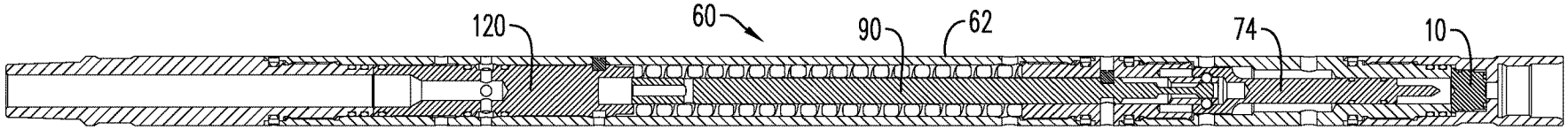
FIG. 9 is a cross-sectional plan view of a differential flow rate firing head according to an embodiment.

FIG. 9 illustrates an embodiment of the firing head assembly 60 that preserves the primary functions discussed previously. That is, in the FIG. 9 embodiment, accidental release of the firing pin 76 is prevented under as many circumstances as possible and the firing head assembly 60 will only release the firing pin 76 in response to the operator performing a deliberate operation. The deliberate operation performed by the operator is conveyed to the firing head assembly 60 and the firing pin 76 is released to strike percussion initiator 10. Some elements of the FIG. 9 embodiment are very similar to elements in the FIG. 3 embodiment and some are different. The description of the FIG. 9 embodiment, below, will focus on differences between the FIG. 9 structural elements compared to the FIG. 3 elements described above.

Figure 10A:
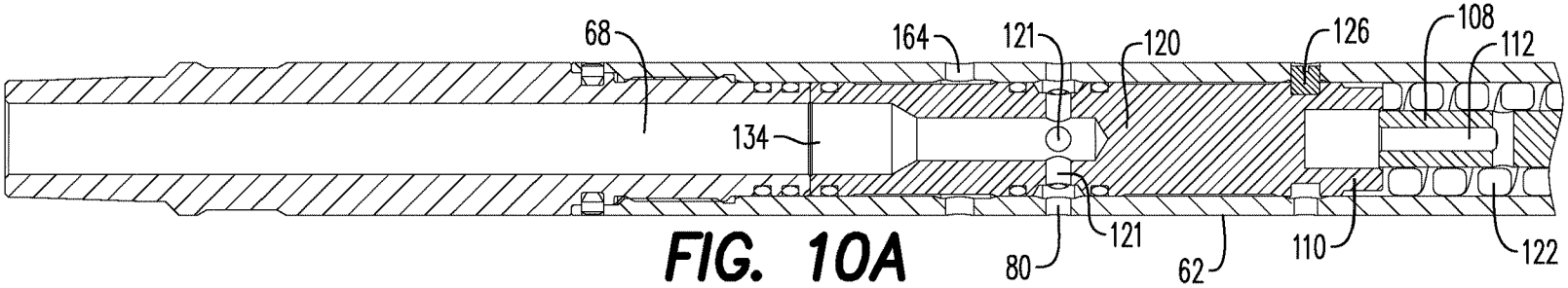
FIG. 10A is a cross-sectional plan view of a circulating valve portion of the FIG. 9 firing head embodiment prior to the operation thereof.
Figure 10B:
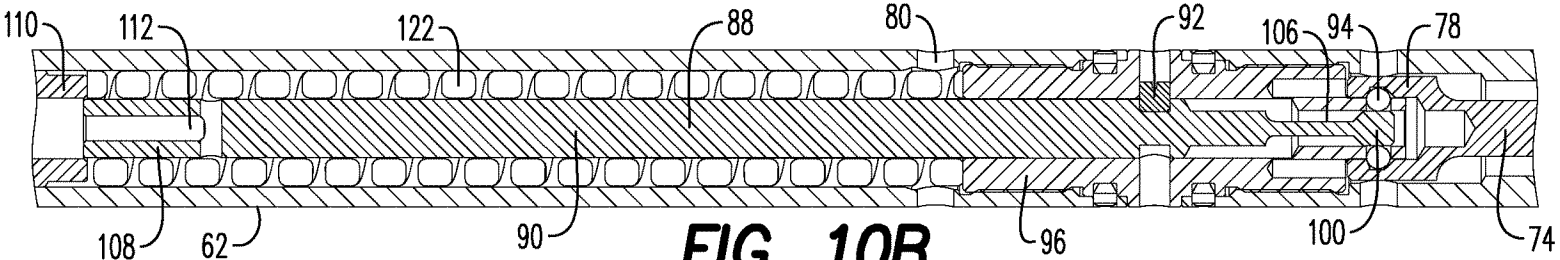
FIG. 10B is a cross-sectional plan view of a lock mandrel portion of the FIG. 9 firing head embodiment prior to the operation thereof.
Figure 10C:
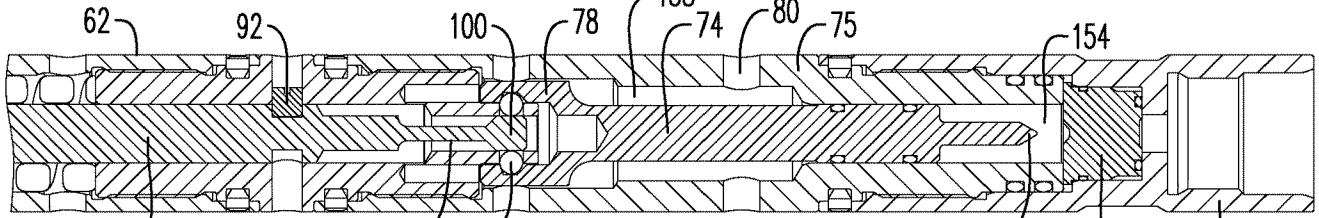
FIG. 10C is a cross-sectional plan view of a firing pin portion of the FIG. 9 firing head embodiment prior to the operation thereof.

FIGS. 10A, 10B and 10C show details of three portions of the firing head assembly of FIG. 9 under passive conditions, i.e., the operator is not pumping fluid into the wellbore in an effort to activate the firing head 60. As seen in FIG. 10A, the circulating valve 120 is biased toward the tubular housing 62 by the biasing member 122. Since the operator is not pumping fluid into the wellbore, little to no axial force is acting on the circulating valve 120 and the biasing member 122 holds the circulating valve 120 in place. In addition, one or more valve sleeve shear pins 126 link the external surface of the circulating valve 120 and the internal surface of the tubular housing and retain the circulating valve 120 in place until the shear pins 126 are sheared. Other than the foregoing, the circulating valve 120 of the FIG. 9 embodiment is quite different from the FIG. 3 embodiment. As shown in FIG. 10A, fluid flowing through the tubular housing lumen 68 can flow through a set of circulating valve holes 121 and then radially through a set of fluid holes 80 in the annular wall of the tubular housing 62. No other fluid flow paths are found in the circulating valve 120 beyond the circulating valve holes 121.

When activation of the firing head is desired, fluid is pumped from the surface to the firing head assembly 60. A portion of the fluid pumped flows through the circulating valve 120 and out the circulating valve holes 121. Above a certain flowrate, the fluid pumping results in a pressure differential across the circulating valve 120 and, thus, an axial force on the circulating valve 120. The axial force on the circulating valve is resisted by the shear pins 126 (if present) and by the biasing member 122. The operator increases the flow rate, i.e., pressure, until the shear pins 126 can no longer resist the axial force, i.e., the shear pins 126 shear and no longer prevent axial movement of the circulating valve 120. Flow rates of between about 2 barrels/minute ("bbl/min") and 5 bbl/min are typical flow rates. If the shear pins 126 are not present, then the axial force on the circulating valve 120 compresses the biasing member 122.

Figure 11A:
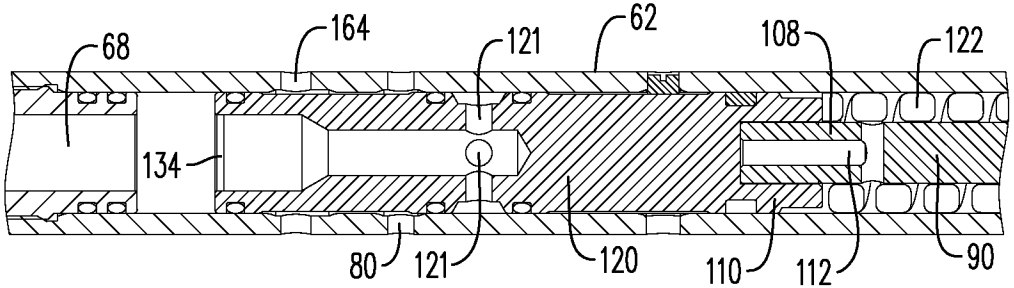
FIG. 11A is a cross-sectional plan view of the circulating valve portion of the FIG. 9 firing head embodiment during the operation thereof.
Figure 11B:
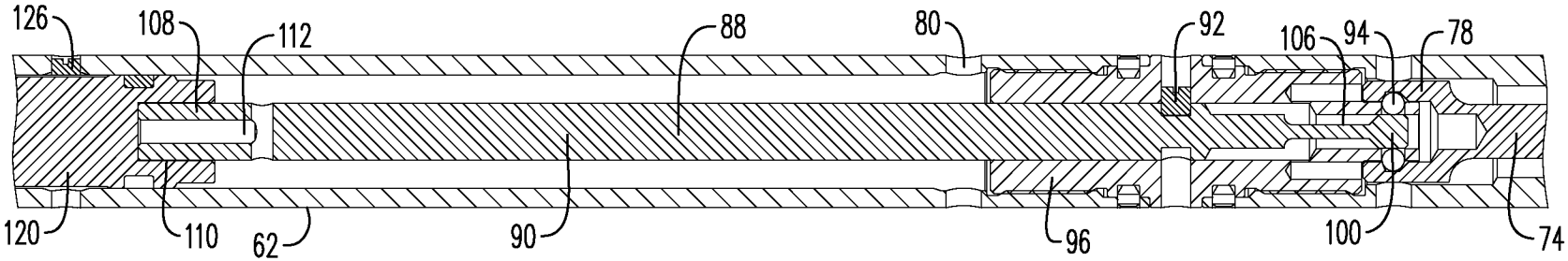
FIG. 11B is a cross-sectional plan view of the firing pin portion of the FIG. 9 firing head embodiment during the operation thereof.

As shown in FIG. 11A, a sufficient fluid flow rate has been pumped downhole by the operator such that the shear pins 126 have failed and the biasing member 122 has been compressed by the axial shift of the circulating valve 120 toward the lock mandrel 90. This shift will only occur if the axial force exerted on the circulating valve 120 is greater than the force exerted by the biasing member 122. These forces should, at least to some extent, be known and may be used to estimate the flow rate/pressure that needs to be pumped into the wellbore to activate the firing head. At a point after the circulating valve 120 begins to shift toward the lock mandrel 90, the circulating valve holes 121 in circulating valve 121 move out of communication with the fluid holes 80 in the tubular housing 62. This eliminates fluid flow out of the circulating valve 120. As a result, the flow rate/pressure exerted by the fluid being pumped from the surface is concentrated on shifting the circulating valve 120 toward the lock mandrel 90. The shift of the circulating valve 120 toward the lock mandrel eventually results in a circulating valve bushing 110 at the end of circulating valve 120 striking the lock mandrel proximal end 108.

As shown in FIG. 10B, the lock mandrel 90 is considerably longer than the lock mandrel of FIG. 3, extending from a proximal end 108 adjacent the circulating valve 120 to a distal end 100 that supports the latch ball bearings 94 in the locked position. The longer lock mandrel 90 is partially the result of the elimination of the valve sleeve 124 and shear bushing 130 from the FIG. 9 embodiment. Between the proximal end 108 and the distal end 100 of the lock mandrel 90, a central shaft 88 passes through an axial bore formed by the biasing member 122. The proximal end 108 of the lock mandrel 90 includes a fluid pressure relief bore 112 so that circulating valve bushing 110 will not be prevented from engaging and exerting force on the proximal end 108 by fluid trapped between the two elements. As best shown in FIGS. 10B and 12B, the lock mandrel groove 106 of the FIG. 9 embodiment is also substantially longer than in the FIG. 3 embodiment. Among other functions, the increased length of the lock mandrel groove 106 eliminates the potential that the latch ball bearings 94 may fail to drop into the groove 106 when the lock mandrel is shifted toward the firing pin holder 74.

Figure 12A:
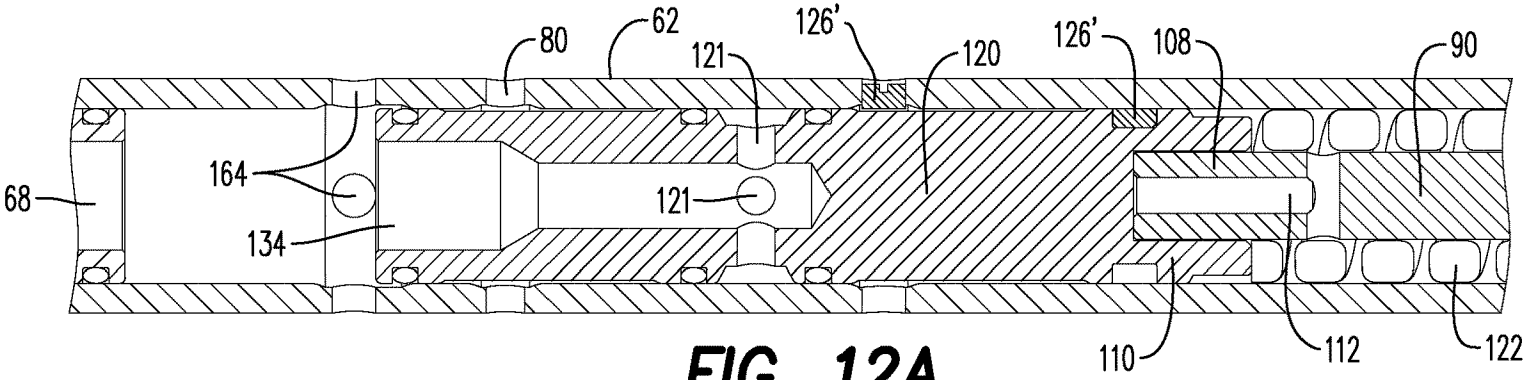
FIG. 12A is a cross-sectional plan view of the circulating valve portion of the FIG. 9 firing head embodiment subsequent to the operation thereof.
Figure 12B:
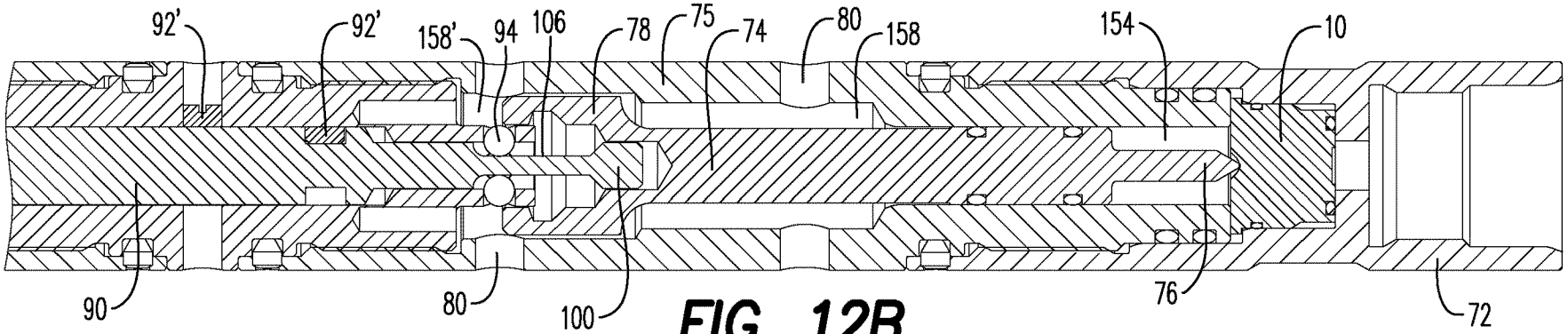
FIG. 12B is a cross-sectional plan view of the firing pin portion of the FIG. 9 firing head embodiment subsequent to the operation thereof.

As illustrated in FIG. 12A, subsequent to the application of sufficient fluid flow rate, the circulating valve 120 has overcome the forces of the now sheared shear pins 126' and the biasing member 122 which is now compressed. The circulating valve bushing 110 has engaged the lock mandrel proximal end 108 and exerted an axial force on the lock mandrel 90 sufficient to shear the lock mandrel shear pin(s) 92; the sheared pin portions 92' are shown in FIG. 12B. Also shown in FIG. 12B, the distal end 100 of the lock mandrel 90 has shifted axially in the direction of the firing pin holder 74, permitting the latch ball bearings 94 to be received in the lock mandrel groove 106; the latch ball bearings 94, therefore, no longer prevent movement of the firing pin holder 74.

As illustrated in FIG. 10C, the firing pin housing 75 is an extension of the tubular housing 62. The firing pin holder 74 and firing pin housing 75 have some changes between the FIG. 3 embodiment and the FIG. 9 embodiment. For example, pressure in the firing pin housing lumen 158 is equalized directly with the pressure external to the firing head assembly 60 through the fluid holes 80, as illustrated in FIG. 10C and FIG. 12B. Another portion of the firing pin housing lumen 158' is also exposed to the pressure external to the firing head assembly 60 through the fluid holes 80, as best shown in FIG. 12B.

Similar to the FIG. 3 embodiment, upon the latch ball bearings 94 releasing the firing pin holder 74, as shown in FIG. 12B, a significant pressure differential may exist between the pressurized fluid in the firing pin housing lumen 158, 158' and the relatively unpressurized air contained in the air chamber 154. A sufficient pressure differential will cause the firing pin holder 74 to slide axially and drive the firing pin 76 into the percussion initiator 10 with significant force.

The FIG. 9 embodiment preserves another important safety feature of the embodiment illustrated in FIGS. 3-8. In the absence of significant fluid pressure in the firing pin housing lumen 158, 158' the firing pin holder 74 and firing pin 76 will not move, at least not with sufficient force to activate the percussion initiator 10. That is, if the latch ball bearings 94 release the firing pin holder 74 under conditions where a significant pressure differential does not exist between the pressurized fluid in the firing pin housing lumen 158 and the air contained in the air chamber 154, the firing pin holder 74 will not drive the firing pin 76 into the percussion initiator 10, at least not with great enough force to activate the percussion initiator 10. Thus, accidental disengagement of the ball bearings 94 from the firing pin holder 74 will not result in accidental activation of the percussion initiator 10 under most circumstances. Significant pressure outside the firing head assembly 60, i.e., around the tubular housing 62 and firing pin housing 75, and inside the firing pin housing lumen 158, 158' are a condition precedent to driving the firing pin 76 with sufficient force to activation the percussion initiator 10. Since almost all circumstances external to a wellbore lack significant pressure, inadvertent triggering of the percussion initiator is highly unlikely. This is a significant safety advantage.

FIG. 12A also shows how one or more circulation restoring holes 164 are uncovered once the circulating valve 120 moves to its final position shown in FIG. 12A. At this point, circulation of fluid around and past the majority of the firing head assembly 60 is restored to the system. However, opening of the circulation restoring holes 164 results in an immediate reduction in the pressure differential across the circulating valve 120 and, thus, the axial force on the circulating valve toward the lock mandrel 90. At this point, the force exerted by biasing member 122 will tend to move the circulating valve 120 back towards its original position, i.e., in FIG. 10A.

Figure 13A:
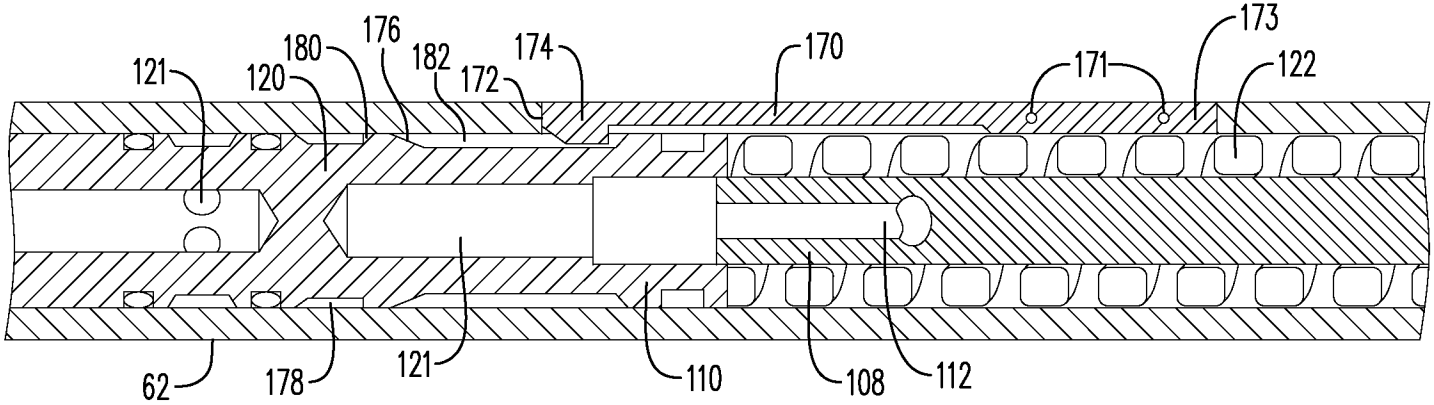
FIG. 13A is a cross-sectional plan view of a latch portion of the FIG. 9 firing head embodiment prior to the operation thereof.
Figure 13B:
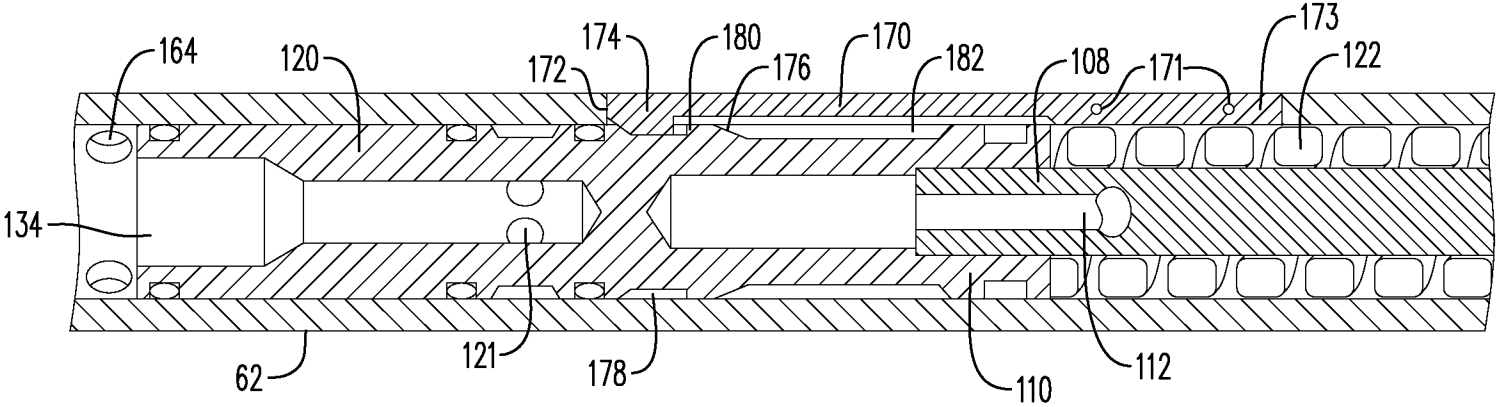
FIG. 13B is a cross-sectional plan view of a latch portion of the FIG. 9 firing head embodiment subsequent to the operation thereof.

FIGS. 13A and 13B illustrate a structure to prevent circulating valve 120 from moving backwards and obstructing the circulation restoring holes 164. A circulating valve latch 170 is attached to the tubular housing 62 by one or more latch connectors 171 at a connection end 173 of the latch 170. A latch head opening 172 extends through the tubular housing 62 and allows the latch head 174 to extend into the lumen 68 of the tubular housing 62.

FIG. 13A shows the circulating valve latch 170 in its initial position, i.e., prior to the operator increasing the fluid flow rate to activate the firing head. The latch head 174 in FIG. 13A is disposed in a latch sliding groove 182 formed in the external surface of the circulating valve 120.

As the circulating valve 170 moves toward the lock mandrel 90 during activation of the firing head assembly 60, the latch head 174 slides along latch sliding groove 182 until the leading edge of latch head 174 engages a latch head ramp 176 portion of a latch head ring 180 formed on the external surface of the circulating valve 120. The connection end 173 of the latch 170 is held stationary but the remainder of the latch 170 acts as a beam with one free end and one fixed end. The upward force on the latch head 174 causes the latch 170, like a beam, to deflect upward. This upward beam deflection permits the latch head 174 to slide over the latch head ring 180. Once the latch head 174 is past the latch head ring 180, no upward force is being exerted on the latch head 174 and the latch 170 returns to the position shown in FIG. 13B.

As also seen in FIG. 13B, the abutting portions of the latch head 174 and the latch head ring 180 have profile shapes that result in this arrangement being 'locked'. That is, once the latch head 174 is disposed in the latch groove 178, as shown in FIG. 13B, there is essentially no way to reverse this arrangement without dismantling the firing head assembly 60. This being the case, in spite of the force of the biasing member 122 on the circulating valve 120 as well as any other forces, the circulating valve 120 cannot move relative to the tubular housing 62 once the latch head 174 is disposed in the latch groove 178.

Figure 14A:
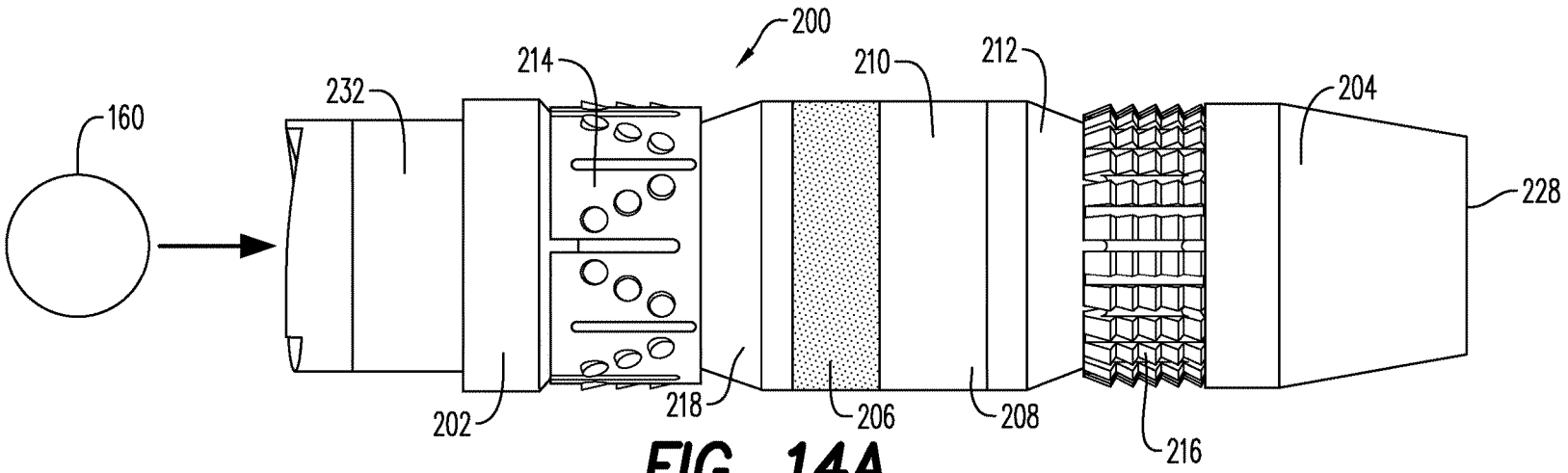
FIG. 14A (PRIOR ART)
FIG. 14A is a side, plan view of a prior art frac plug and drop ball.
Figure 14B:
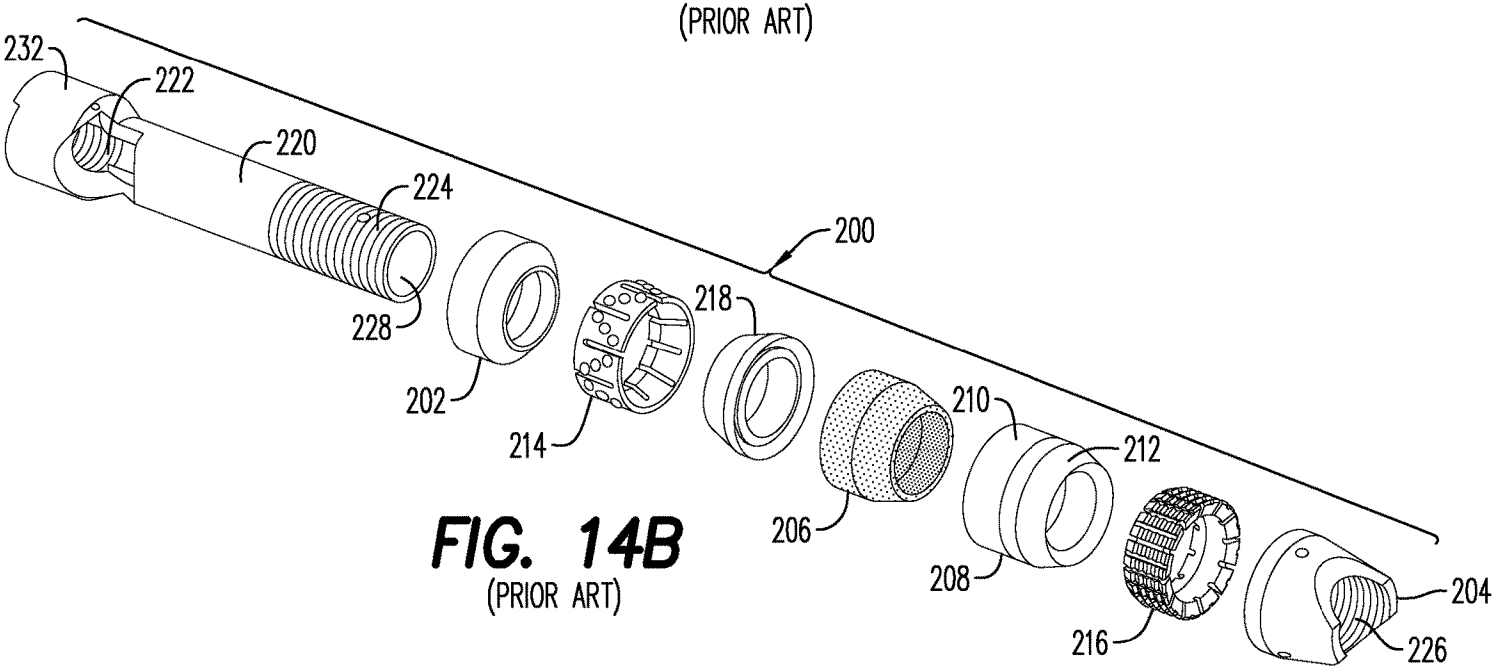
FIG. 14B (PRIOR ART)
FIG. 14B is a side, perspective, exploded view of the prior art frac plug of FIG. 14A.

FIG. 14A shows a typical frac plug 200 and drop ball 160. FIG. 14B is an exploded view of the typical frac plug 200 of FIG. 14A. The frac plug 200 has a bearing plate 202 at one end and a bottom plate 204 at the other end. Between the bearing plate 202 and the bottom plate 204 are a number of ring-shaped elements performing various functions. Most important among these ring-shaped elements are those elements capable of substantial deformation.

A seal element 206 is made from a material that may be deformed. Deformation of the seal element 206 causes a bulge that fills the space between the frac plug 200 and the inner-wall of the wellbore. This bulge engages the wellbore sufficiently to both block fluid and to hold the frac plug 200 in place. Other seal elements may also have deformable portions. For example, a seal anvil 208 may have a flexible portion 210 and a rigid portion 212; the flexible portion 210 may deform along with the seal element to assist in the dual functions of blocking fluid and holding the frac plug 200 in place. Many different deformable materials are available in different frac plugs, such as rubber, elastomers and other polymers. Some deformable materials are much harder than rubber elements in the example chosen and actually 'dig in' to the wellbore wall to increase the anchoring strength.

A top slip 214 and a bottom slip 216 transfer force from, respectively, the top plate 202 and the bottom plate 204. The top slip 214 transfers force from the top plate 202 to an anvil cone 218. The anvil cone 218 exerts a compressive force on the seal element 206. The bottom slip transfers force from the bottom plate 204 to the seal anvil 208. The seal anvil exerts a compressive force on the seal element 206. Thus, the anvil cone 218 and seal anvil 208 each exert a compressive force on the seal element 206, causing the seal element 206 to bulge into the space between the frac plug 200 and the inner-wall of the wellbore.

Mandrel 220 is disposed in a central bore formed by the ring-shaped elements of the frac plug 200. Means is provided on the mandrel 220, e.g., outer mandrel threads 224, for attaching the mandrel to the bottom plate 204 via bottom plate threads 226. Mandrel 220 is not attached to any other ring-shaped element. Thus, the mandrel 220 will hold the bottom plate 204 in place while the remaining ring-shaped elements are free to displace axially. Thus, a force exerted on the bearing plate 202 while the mandrel 220 and bottom plate are held in place will cause compressive forces to be exerted on the seal element 206 by the seal anvil 208 and the anvil cone 218. The mandrel 220 is held in place by a setting tool (not shown), e.g., by connecting to inner threads 222. Simultaneously with holding the mandrel 220 in place, a sleeve of the setting tool exerts a strong force on the bearing plate, thus setting the frac plug in place. U.S. Pat. No. 2,807,325 is an example of a setting tool and frac plug operating along the lines generally described herein and is incorporated herein in its entirety.

The frac plug 200 has a central lumen 228 extending along its entire length, permitting fluid to flow through and, thus, past the frac plug 200 when disposed in a wellbore. That is, each of the ring-shaped elements and the mandrel 220 have a central bore which forms the central lumen 224 of the frac plug 200.

It is sometimes desired to permit fluid flow in one direction through the frac plug 200 while preventing fluid flow in the opposite direction. As seen in FIG. 14B, a drop ball 160 may be used to accomplish this. The drop ball 160 is slightly larger than the entrance to the central lumen 228 in the mandrel head 232. Thus, if the drop ball 160 is present, fluid flow into the mandrel head 232 end of the frac plug and from there through the frac plug 200 will not be permitted. Fluid flow in the opposite direction, i.e., entering the central lumen 228 adjacent the bottom plate 204, is permitted since the drop ball 160 is pushed away from the mandrel head 232 by flow in this direction. Drop ball cages (not shown) are sometimes provided around the drop ball. These are primarily for the purpose of keeping the ball near the entry portion while still allowing flow in one direction. Use of drop balls, even with drop ball cages, can be problematic for a number of reasons, primarily related to the reliability of properly seating and unseating the drop ball in the appropriate location to cease and restore flow. The use of a drop ball cage to improve this reliability is not fully effective and comes at the cost of additional structure that may interfere with other operations and is somewhat delicate. Failure of drop balls and drop ball cages to perform the functions for which they were designed is frequent and can be costly to operations.

According to an embodiment, it is contemplated to eliminate the drop ball or similar element from the frac plug 200. The function of the drop ball would be performed by a differential pressure valve of the type illustrated in FIGS. 3-6. The differential pressure valve will also avoid the problems inherent in any drop ball based frac plug 200.

Figure 15A:
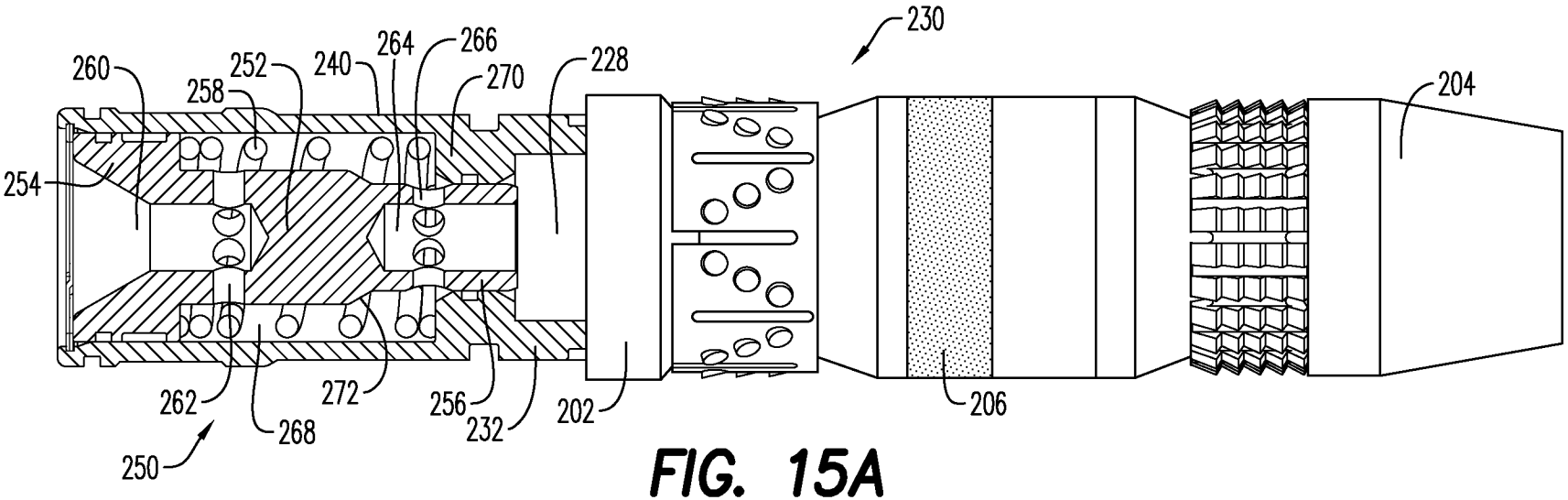
FIG. 15A is a side, plan, partial cross-section of a differential pressure frac plug in an open arrangement, according to an embodiment.

An exemplary differential pressure frac plug 230 is illustrated in FIG. 15A. According to an embodiment, a differential pressure valve assembly 250 replaces the drop ball in enabling one-way flow through a frac plug 200. Much of the frac plug structure is similar to the frac plug 200 of FIGS. 14A and 14B. The portion of differential pressure frac plug 230 that is different from the frac plug 200 is shown in cross section while the retained structure is not shown in cross-section.

FIG. 15A illustrates a differential circulating valve 252 disposed in a valve sleeve 240. The differential circulating valve 252 has a piston end 254 and a sealing end 256. The housing 240 may be an extension of or an attachment to the frac plug mandrel head 202. A biasing member, such as a coil spring 258, pushes the piston end 254 away from the frac plug mandrel head 202. The outer walls of the piston end 254 of the valve 252 are in a substantially sealed relationship with the inner walls of the valve sleeve 240, which sealed relationship may be augmented with o-rings (not shown). A piston bore 260 extends from the piston end 254 of the valve 252 into the body thereof and may have a tapered entrance portion. A set of circulating holes 262 extend from the piston bore 260 outwardly through the circulating valve 252 and connect the piston bore 260 to a valve sleeve bore 268. A sealing bore 264 extends through the sealing end 256 of the valve 252. A set of circulating holes 266 extend from the sealing bore 264 outwardly through the circulating valve 252 and connect the sealing bore 264 to the valve sleeve bore 268. The piston bore 260 and the sealing bore 264 are not directly connected to each other, i.e., fluid must pass into the valve sleeve bore 268 to reach the sealing bore 264 from the piston bore 260.

The arrangement of bores and circulating holes is such that, in the arrangement illustrated in FIG. 15A, fluid may pass freely through the piston end 254 of the valve 252, the valve bore 260, the piston end circulating holes 262, the valve sleeve bore 268, the sealing end circulating holes 266 and the sealing end bore 264. Since the sealing end bore 266 is connected directly with the central lumen 228 of frac plug 230, fluid may pass through the differential pressure valve assembly 250 of FIG. 15A and into the central lumen of frac plug 230. This is true whether or not the frac plug 240 has been activated, i.e., whether or not the seal element 206 has been caused to expand by the operation of a setting tool or otherwise.

The sealing end 256 of the circulating valve 252 is of lesser diameter than the piston end 254 and passes through a reduced diameter portion 270 of the valve sleeve 240. A valve seat 272 is formed on the reduced diameter portion 270 of the valve sleeve 240, among other functions, supports the biasing member 258; neither the piston end 254 nor the biasing member 258 can pass the reduced diameter portion 270 of the valve sleeve 240. The outer walls of the sealing end 256 and the inner walls of the reduced diameter portion 270 of the valve sleeve 240 establish a seal between the valve sleeve bore 268 and the frac plug central lumen 228; this seal may be augmented with o-rings (not shown, though an o-ring seat is shown).

FIG. 15A illustrates the differential pressure frac plug 230 under passive conditions, the circulating valve 252 is pushed away from the frac plug portion by the biasing member 268. As previously discussed, fluid is able to flow through and past the circulating valve 252 of FIG. 15A and into the frac plug central lumen 228. Biasing element 268 holds the circulating valve 252 in place.

Figure 15B:
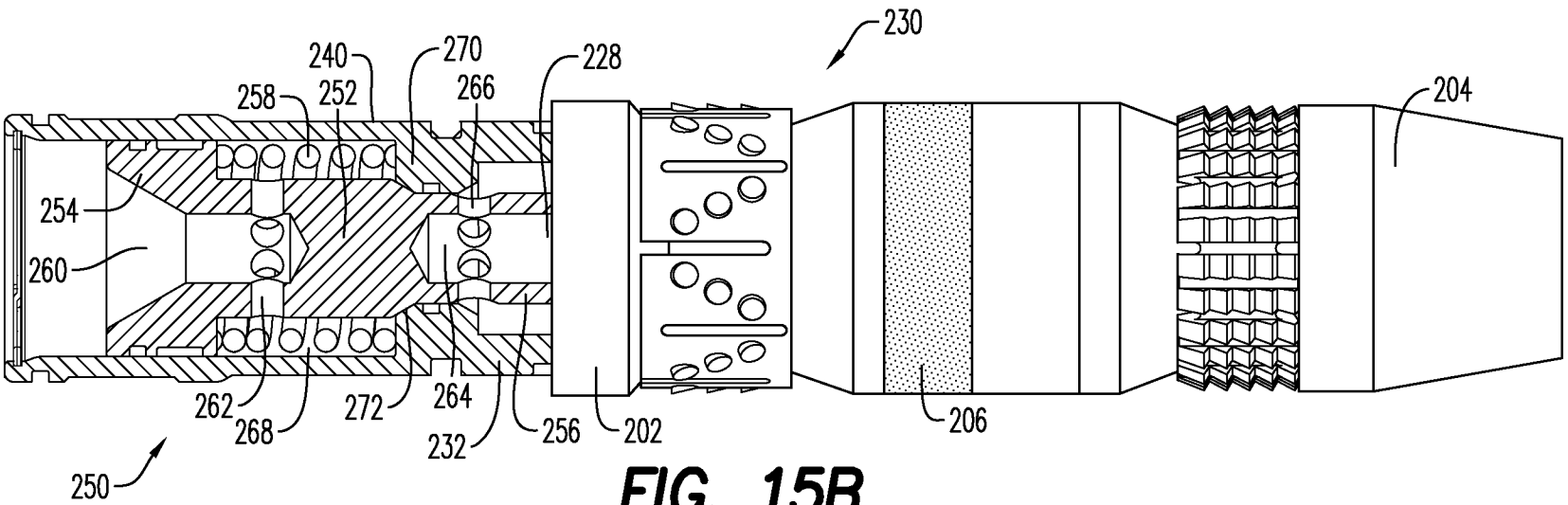
FIG. 15B is a side, plan, partial cross-section of the differential pressure frac plug of FIG. 15A in a closed arrangement.

FIG. 15B illustrates the differential pressure frac plug 230 where an axial force has been exerted on the piston end 254 of the circulating valve 252. This axial force was sufficient to overcome the force exerted on the circulating valve 252 by the biasing member 268. The circulating valve 252 has shifted toward the frac plug and compressed the biasing member 268. The axial force may be the result of operator increasing the flow rate of fluid in the wellbore, similar to other embodiments described previously. This increased flow rate would create a pressure differential across the circulating valve 252 and, thus, an axial force on the piston end of the valve 252. If the axial force continues to rise, the circulating valve 252 eventually abuts the valve seat 272 of the valve sleeve 240 and any additional axial force resulting from the pressure difference across the circulating valve 252 is exerted on the valve sleeve 240.

The shift of circulating valve 252 to the position shown in FIG. 15B has significant impact of fluid flow in the area of the differential pressure frac plug 230. In the arrangement shown in FIG. 15B, the sealing end circulating holes 266 are blocked off by the reduced diameter section 270 of the valve sleeve 240. The sealing end bore 264 is no longer in fluid communication with the valve sleeve bore 268. Therefore, fluid can no longer flow from the piston end 254 through and past the circulating valve 252 and into the frac plug central lumen 228. Put another way, sufficient axial force placed on the piston end 254 of the valve 252 results in closure of the valve 252. Again, since an operator may exert an axial force on the piston end 254 of the valve 252 by pumping fluid into the wellbore, this means that the operator may close the circulating valve 252 and, thus, eliminate fluid flow through the frac plug 230.

Once the sealing end circulating holes 266 are blocked and fluid flow through the valve 252 is eliminated, it is no longer typically necessary to continue to pump fluid into the wellbore. Rather, merely maintaining the static pressure acting on the piston end 254 of the valve 252 sufficiently to compress biasing member 258 will maintain status quo. Reducing the static pressure in the wellbore adjacent the piston end 254 of the valve 252 will eventually result in the biasing member pushing the valve away from the frac plug 230. Once this shift in the valve exposes the sealing end circulating holes 266 to the valve sleeve bore 268, fluid pressure on all sides of the valve 252 will equalize and the passive conditions of FIG. 25A will be restored. Once more, since an operator may control flow rate and pressure in the wellbore, this means that the operator may open the circulating valve 252 and, thus, restore fluid flow through the frac plug 230.

Besides a reduction in pressure to the left of the circulating valve 252, an increase in pressure to the right of the circulating valve 252 may result in the biasing member 258 becoming less compressed and, possibly, returning fluid flow through the differential pressure valve assembly 250 and frac plug 230. This, however, would be an unusual circumstance since the right side of the circulating valve 250 is typically inaccessible and at a steady state.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A firing head assembly for use with an initiator, the firing head assembly comprising:

a tubular housing having a first end, a second end and a lumen extending between the first end and the second end;

a valve slidably disposed within the tubular housing, the valve having a piston end exposed to the tubular housing lumen;

a lock mandrel disposed in the tubular housing between the valve and the tubular housing second end;

a lock mandrel shear element configured to restrain axial movement of the lock mandrel;

a firing pin holder disposed in the tubular housing between the lock mandrel and the tubular housing second end, the firing pin holder having a firing pin and a latch; and one or more fluid holes extending through the tubular housing, wherein the one or more fluid holes and the firing pin holder intersect with a common plane that is perpendicular to the longitudinal axis of the tubular holder, and the one or more fluid holes expose a portion of the firing pin holder to a fluid flow condition existing external to the tubular housing; and an engagement mechanism in contact with the lock mandrel and the latch, wherein the engagement mechanism is switchable between an engaged arrangement and a disengaged arrangement, wherein the firing pin is configured to activate the initiator in response to the fluid flow condition external to the tubular housing exceeding a first threshold.

2. The firing head assembly of claim 1, wherein the first threshold is fluid pressure that is substantially higher than atmospheric pressure.

3. The firing head assembly of claim 1, further comprising:

at least one valve restraining element, wherein the valve restraining element is configured to:

prevent axial movement of the valve, and allow axial movement of the valve in response to a force exerted on the valve exceeding a second threshold.

4. The firing head assembly of claim 3, wherein the valve restraining element is at least one of a shear element or a biasing element.

5. The firing head assembly of claim 1, wherein when in the engaged arrangement, the engagement mechanism restrains the firing pin holder from axial movement relative to the firing head assembly; and when in the disengaged arrangement, the engagement mechanism is disengaged from the firing pin latch and does not restrain axial movement of the firing pin holder relative to the firing head assembly.

6. The firing head assembly of claim 1, wherein the lock mandrel comprises a groove formed in a surface of the lock mandrel.

7. The firing head assembly of claim 6, wherein the engagement mechanism operably contacts the lock mandrel at a position adjacent to the groove.

8. The firing head assembly of claim 7, wherein the engagement mechanism is configured to enter the groove in response to an axial movement of the lock mandrel.

9. A firing head assembly comprising:

a tubular housing having a proximal end, a distal end and a tubular housing lumen extending between the proximal end and the distal end;

a valve sleeve having a proximal end, a distal end and a valve sleeve axial lumen, the valve sleeve slidably disposed within the tubular housing lumen;

a circulating valve slidably disposed within the valve sleeve axial lumen, the circulating valve having a piston end with a valve entrance and piston end circulating holes and a sealing end with sealing end circulating holes, a first section of the valve sleeve axial lumen sized to sealingly accommodate the piston end of the circulating valve and a second section of the valve sleeve axial lumen being of a reduced diameter to sealingly accommodate the sealing end of the circulating valve, a sealable section of the valve sleeve axial lumen is located between the second, reduced diameter section of the valve sleeve lumen and distal end of the valve sleeve;

a biasing member configured to exert a force on the circulating valve toward the proximal end of valve sleeve; and an annulus defined by the piston end of the circulating valve, an inner wall of the valve sleeve, the second, reduced diameter section of the valve sleeve axial lumen and a circulating valve body portion connecting the piston end and the sealing end of the circulating valve, wherein;

the piston end entrance is in fluid communication with the tubular housing lumen and the piston end circulating holes;

the sealing end circulating holes are in fluid communication with the sealable lumen, the circulating valve occupies one of a circulating position or a non-circulating position in the valve sleeve, the circulating position being configured to allow fluid circulation between each of the tubular housing lumen, the piston end entrance, the piston end circulating holes, the annulus, the sealing end circulating holes and the sealable section of the valve sleeve axial lumen, and the non-circulating position is configured to prevent circulation between the annulus and sealing end circulating holes.

10. The firing head assembly of claim 9, further comprising:

a plurality of valve sleeve shear elements connecting the valve sleeve to the tubular housing and restraining axial movement of the valve sleeve toward the proximal end of the tubular housing.

11. The firing head assembly of claim 10, further comprising:

a lock mandrel;

a lock mandrel housing disposed about the lock mandrel;

a lock mandrel shear element in engagement with the lock mandrel housing and the lock mandrel, the lock mandrel shear element configured to restrain axial movement of the lock mandrel relative to the lock mandrel housing;

a firing pin attached to a firing pin holder, the firing pin holder having a firing pin holder latch; and an engagement mechanism between the lock mandrel and the firing pin holder latch, wherein the firing pin holder and firing pin are restrained from axial movement by the engagement mechanism contacting the firing pin holding latch, contact between the engagement mechanism and the firing pin holding latch is only removed by axial movement of the lock mandrel resulting in alignment of the engagement mechanism and the groove such that the engagement mechanism engages the groove and no longer contacts the firing pin holding latch, and an operator controlled force exerted on the circulating valve is configured to move the circulating valve from the circulating position to the non-circulating position and the operator controlled force is transmitted from the circulating valve to the valve sleeve, causing the valve sleeve shear elements to fail, failure of the valve sleeve shear elements permits a distal end of the valve sleeve to strike the lock mandrel causing the lock mandrel shear element to fail and axial movement of the lock mandrel resulting in alignment of the engagement mechanism and the groove and, thus, release of the firing pin holder and firing pin.

12. The firing head assembly of claim 11, wherein the operator controlled force is exerted by a pump controlled by the operator.

13. The firing head assembly of claim 11, wherein the engagement mechanism comprises a ball bearing.

14. The firing head assembly of claim 11, wherein the engagement mechanism is forced into contact with the firing pin holder latch by the distal end of the lock mandrel.

15. The firing head assembly of claim 11, further comprising:

a lock mandrel housing rigidly attached to the tubular housing, wherein the lock mandrel shear element is rigidly connected to the lock mandrel housing and the lock mandrel, and an axial force exerted on the lock mandrel is configured to create a shear force in the lock mandrel shear element.

16. The firing head assembly of claim 9, wherein the circulating position of the circulating valve allows fluid communication through each of the tube, tubular housing lumen, annulus and sealable section of the valve sleeve axial lumen and the sealed position of the valve prevents fluid communication from the annulus to the sealable section of the valve sleeve axial lumen.

17. A method for activating a firing head assembly, the method comprising the steps of:

disposing the firing head assembly adjacent a downhole tool, the firing head assembly comprising:

a tubular housing having a first end, a second end and a lumen extending between the first end and the second end;

a valve sleeve slidably disposed within the tubular housing lumen adjacent the first end of the tubular housing;

a valve slidably disposed within the valve sleeve, the valve having a piston end exposed to the tubular housing lumen at the first end of the tubular housing;

a lock mandrel having a head, a shaft, a distal end and a groove formed in the shaft adjacent the distal end; and a firing pin holder having an integral firing pin and a firing pin bolder latch;

restraining axial movement of the valve sleeve in the tubular housing by one or more valve sleeve shear elements;

restraining axial movement of the lock mandrel within the tubular housing by one or more lock mandrel shear elements;

restraining the firing pin holder and firing pin from axial movement relative to the tubular housing by an engagement mechanism operably disposed between and contacting the lock mandrel and the firing pin holder latch;

exerting a force on the valve in the absence of a drop ball;

transmitting the force from the valve to the valve sleeve, resulting in failure of the valve sleeve shear element and releasing the valve sleeve to move axially;

transmitting the force from the valve sleeve to the lock mandrel, resulting in failure of the lock mandrel shear element and releasing the lock mandrel to move axially;

releasing the firing pin holder and firing pin by aligning the engagement mechanism and the lock mandrel groove.

18. The activating method of claim 17, further comprising:

driving the firing pin holder and firing pin utilizing a hydrostatic force in a wellbore.

19. The activating method of claim 17, further comprising:

increasing the force by sealing one or more sealing end circulating holes.

* * * * *